US011000092B2

(12) United States Patent
Hull et al.

(10) Patent No.: US 11,000,092 B2
(45) **Date of Patent: *May 11, 2021**

(54) ARTICULATED SOLE STRUCTURE WITH SIPES FORMING HEXAGONAL SOLE ELEMENTS

(71) Applicant: NIKE, Inc., Beaverton, OR (US)

(72) Inventors: Zachary E. Hull, Portland, OR (US); John A. Truax, Portland, OR (US); Robert W. Dolan, Portland, OR (US); Mark C. Miner, Portland, OR (US); Angela N. Martin, Lake Oswego, OR (US); Robert C. Williams, Jr., Tigard, OR (US); Karen S. Dimoff, Portland, OR (US); Jekti Hadiati, Beaverton, OR (US); Howard Banich, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 838 days.

This patent is subject to a terminal disclaimer.

(21) Appl. No.: 15/477,155

(22) Filed: Apr. 3, 2017

(65) Prior Publication Data

US 2017/0202302 A1 Jul. 20, 2017

Related U.S. Application Data

(63) Continuation of application No. 14/077,987, filed on Nov. 12, 2013, now Pat. No. 9,648,924.

(51) Int. Cl.
*A43B 13/14* (2006.01)
*A43B 13/12* (2006.01)
(Continued)

(52) U.S. Cl.
CPC ..... *A43B 13/141* (2013.01); *A43B 1/0009* (2013.01); *A43B 13/122* (2013.01);
(Continued)

(58) Field of Classification Search
CPC ... A43B 13/141; A43B 13/122; A43B 13/125; A43B 13/223; A43B 13/22; A43B 1/0009; A43B 13/14; A43B 13/181
See application file for complete search history.

(56) References Cited

U.S. PATENT DOCUMENTS

D76,528 S 10/1928 Frey
D237,323 S 10/1975 Inohara
(Continued)

FOREIGN PATENT DOCUMENTS

JP 51115149 A 10/1976
JP S59154105 A 9/1984
(Continued)

OTHER PUBLICATIONS

Mar. 7, 2018—(EP) Examination Report—App 14 806 131.0-1011.

*Primary Examiner* — Ted Kavanaugh
(74) *Attorney, Agent, or Firm* — Banner & Witcoff, Ltd.

(57) ABSTRACT

A footwear sole structure may include a plurality of discrete hexagonally-shaped sole elements defined by a plurality of sipes. The sipes may include a plurality of sipes that extend in a transverse direction across the sole structure and a plurality of sipes that extend in an oblique direction relative to the transverse sipes. A plurality of sipes may also subdivide the hexagonally-shaped sole elements into one or more diamond-shaped sole element portions. The sole structure may include additional features such as non-hexagonal sole elements and lugs distributed across a bottom surface of the sole structure.

15 Claims, 13 Drawing Sheets

(51) Int. Cl.

| | |
|---|---|
| ***A43B 13/37*** | (2006.01) |
| ***A43B 1/00*** | (2006.01) |
| ***A43B 13/22*** | (2006.01) |
| *A43B 13/04* | (2006.01) |
| *A43B 13/18* | (2006.01) |

(52) U.S. Cl.

CPC ..... *A43B 13/14* (2013.01); *A43B 13/223* (2013.01); *A43B 13/37* (2013.01); *A43B 13/04* (2013.01); *A43B 13/181* (2013.01); *A43B 13/22* (2013.01)

(56) References Cited

U.S. PATENT DOCUMENTS

| | | | | |
|---|---|---|---|---|
| D248,897 | S | 8/1978 | Toothaker | |
| D263,645 | S | 4/1982 | Mastrantuone | |
| 4,455,765 | A | 6/1984 | Sjosward | |
| D308,285 | S | 6/1990 | Sema | |
| 5,012,597 | A | 5/1991 | Thomasson | |
| 5,014,449 | A | 5/1991 | Richard et al. | |
| D359,385 | S | 6/1995 | Meraw | |
| 6,029,377 | A * | 2/2000 | Niikura | A43B 13/223 36/59 C |
| 6,115,945 | A * | 9/2000 | Ellis, III | A43B 13/04 36/102 |
| 6,178,662 | B1 | 1/2001 | Legatzke | |
| D463,901 | S | 10/2002 | Adams et al. | |
| D483,934 | S | 12/2003 | Adams et al. | |
| 6,820,353 | B2 | 11/2004 | Oman et al. | |
| D512,821 | S | 12/2005 | Lee | |
| 6,990,755 | B2 | 1/2006 | Hatfield et al. | |
| D549,934 | S | 9/2007 | Horne et al. | |
| D555,339 | S | 11/2007 | Chang | |
| D555,340 | S | 11/2007 | Chang | |
| 7,310,894 | B1 * | 12/2007 | Schwarzman | A43B 5/08 36/3 A |
| D561,986 | S | 2/2008 | Horne et al. | |
| D564,191 | S | 3/2008 | Jensen | |
| D566,941 | S | 4/2008 | Chang | |
| D572,885 | S | 7/2008 | Jensen | |
| D599,087 | S | 9/2009 | Kay et al. | |
| D656,722 | S | 4/2012 | Hall | |
| 8,146,272 | B2 * | 4/2012 | Dukovic | A43B 13/16 36/59 C |
| 8,186,078 | B2 | 5/2012 | Avar et al. | |
| D679,487 | S | 4/2013 | Wawrousek | |
| 9,635,903 | B2 * | 5/2017 | Lawless | A43B 1/0009 |
| 9,648,924 | B2 * | 5/2017 | Hull | A43B 13/141 |
| 9,668,542 | B2 * | 6/2017 | Lawless | A43B 13/223 |
| 2005/0076536 | A1 | 4/2005 | Hatfield et al. | |
| 2008/0201992 | A1 | 8/2008 | Avar et al. | |
| 2010/0269271 | A1 * | 10/2010 | Kim | A43D 8/02 12/146 B |
| 2010/0281714 | A1 | 11/2010 | Carboy et al. | |
| 2010/0299965 | A1 | 12/2010 | Avar et al. | |
| 2011/0247243 | A1 * | 10/2011 | Eder | A43C 15/162 36/67 A |
| 2012/0131816 | A1 * | 5/2012 | Chasco Perez De Arenaza | A43B 1/0009 36/43 |
| 2012/0317843 | A1 * | 12/2012 | Bove | A43B 1/0054 36/25 R |
| 2013/0152428 | A1 | 6/2013 | Bishop et al. | |
| 2013/0199058 | A1 | 8/2013 | Fuerst | |
| 2014/0259744 | A1 * | 9/2014 | Cooper | A43B 13/122 36/28 |

FOREIGN PATENT DOCUMENTS

| | | | |
|---|---|---|---|
| JP | 2005323644 | A | 11/2005 |
| JP | 2009178594 | A | 8/2009 |
| JP | 2009195403 | A | 9/2009 |
| JP | 2011205999 | A | 10/2011 |
| KR | 101040647 | B1 | 6/2011 |

* cited by examiner

ARTICULATED SOLE STRUCTURE WITH SIPES FORMING HEXAGONAL SOLE ELEMENTS

CROSS-REFERENCE TO RELATED APPLICATION

This application is a continuation of U.S. patent application Ser. No. 14/077,987 entitled "Articulated Sole Structure with Sipes Forming Hexagonal Sole Elements" and filed on Nov. 12, 2013, which is incorporated by reference herein in its entirety.

BACKGROUND

Conventional articles of footwear often include two primary components: an upper and a sole structure. The upper provides a covering for the foot and securely positions the foot relative to the sole structure. The sole structure is secured to a lower surface of the upper and configured so as to be positioned between the foot and the ground when a wearer is standing, walking or running. Sole structures are often designed so as to cushion, protect and support the foot. Sole structures may also be designed so as to increase traction and to help control potentially harmful foot motion such as overpronation.

Many types of athletic footwear have a sole structure that includes a deformable midsole. A primary element of many conventional midsoles is a resilient polymer foam material that extends throughout the length of the footwear. The physical characteristics a conventional midsole often depend on the density and other properties of the polymer foam material and on the dimensional configuration of the midsole. By varying these factors throughout the midsole, the relative stiffness, degree of ground reaction force attenuation, and energy absorption properties may be altered to meet the specific demands of the activity for which the footwear is intended to be used.

Commonly-owned U.S. Pat. No. 6,990,755 describes an article of footwear having an articulated sole structure in which multiple sipes separate discrete sole elements of the midsole. The resulting sole structure helps to simulate a sensation of barefoot running while at the same time providing a degree of cushioning and protection to the wearer foot. The motion of a human foot during running and other activities can be quite complex, however. Accordingly, there remains an ongoing need for improved articulated sole structures that better accommodate natural tendencies and kinematics of the human foot.

SUMMARY

This Summary is provided to introduce a selection of concepts in a simplified form that are further described below in the Detailed Description. This Summary is not intended to identify key features or essential features of the invention.

In at least some embodiments, a footwear sole structure may include a plurality of discrete hexagonally-shaped sole elements defined by a plurality of sipes. The sipes may include a plurality of sipes that extend in a transverse direction across the sole structure and a plurality of sipes that extend in an oblique direction relative to the transverse sipes. A plurality of sipes may also subdivide the hexagonally-shaped sole elements into one or more diamond-shaped sole element portions. The sipes may have a sipe depth of about 2 mm to about 3 mm near a forward end of the forefoot region, about 7 mm to about 8 mm near a rear end of the forefoot region, and about 7 mm to about 10 mm in the midfoot region and in the heel region. The sole structure may include additional features such as non-hexagonal sole elements and lugs distributed across a bottom surface of the sole structure. Additional embodiments are described herein.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1:
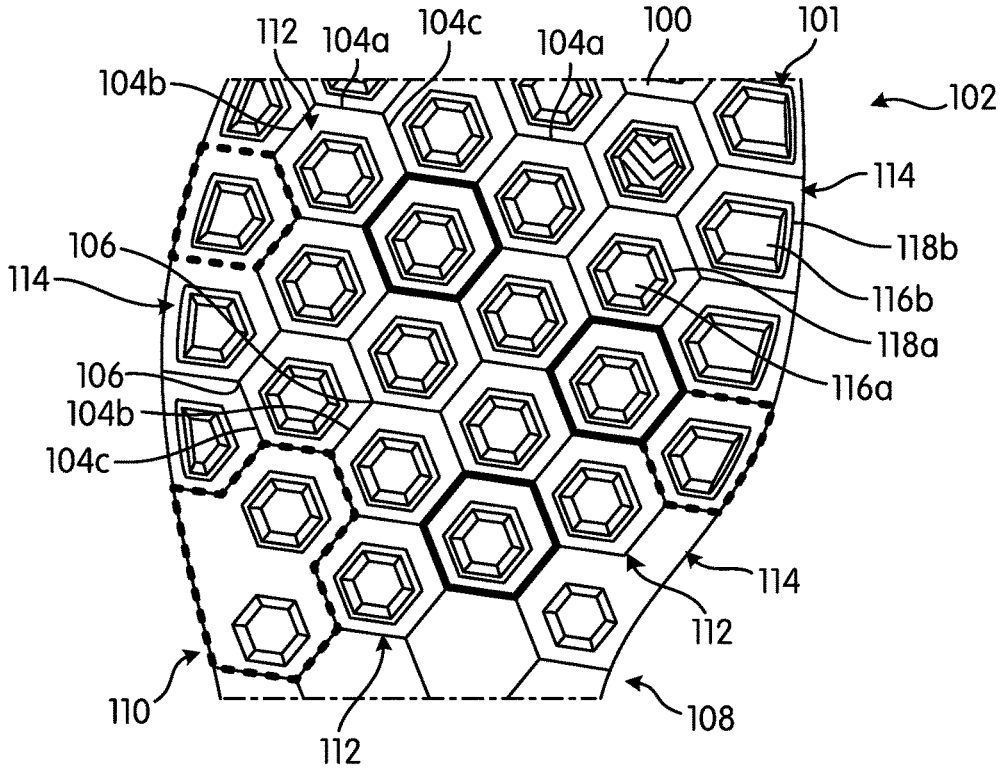
FIG. 1 is a bottom view of a portion of an example of an articulated sole structure according to some embodiments.

The following discussion and accompanying figures describe sole structures in accordance with several embodiments, as well as articles of footwear incorporating such sole structures. The sole structures depicted in the figures and discussed below have configurations that are suitable for athletic activities such as running. Other embodiments include sole structures and footwear having one or more features of the herein-described sole structures and adapted for basketball, baseball, football, soccer, walking, hiking and other athletic and nonathletic activities. Persons skilled in the relevant art will thus recognize that concepts disclosed herein may be applied to a wide range of footwear styles and are not limited to the specific embodiments discussed below and depicted in the figures.

To assist and clarify subsequent description of various embodiments, various terms are defined herein. Unless context indicates otherwise, the following definitions apply throughout this specification (including the claims). "Shoe" and "article of footwear" are used interchangeably to refer to articles intended for wear on a human foot. A shoe may or may not enclose the entire foot of a wearer. For example, a shoe could include a sandal or other article that exposes large portions of a wearing foot. The "interior" of a shoe refers to space that is occupied by a wearer's foot when the shoe is worn. An "interior side" (or surface) of a shoe element refers to a face of that element that is (or will be) oriented toward the shoe interior in a completed shoe. An "exterior side" (or surface) of an element refers to a face of that element that is (or will be) oriented away from the shoe interior in the completed shoe. In some cases, the interior side of an element may have other elements between that interior side and the interior in the completed shoe. Similarly, an exterior side of an element may have other elements between that exterior side and the space external to the completed shoe.

Unless the context indicates otherwise, "top," "bottom," "over," "under," "above," "below," and similar locational terms assume that a shoe or shoe structure of interest is in the orientation that would result if the shoe (or shoe incorporating the shoe structure of interest) is in an un-deformed condition with its outsole (and/or one or more other ground-contacting sole structure elements) resting on a flat horizontal surface. Notably, however, the term "upper" is reserved for use in describing the component of a shoe that at least partially covers a wearer foot and helps to secure the wearer foot to a shoe sole structure.

Elements of a shoe can be described based on regions and/or anatomical structures of a human foot wearing that shoe, and by assuming that shoe is properly sized for the wearing foot. As an example, a forefoot region of a foot includes the metatarsal and phalangeal bones. A forefoot element of a shoe is an element having one or more portions located over, under, to the lateral and/or medial sides of, and/or in front of a wearer's forefoot (or portion thereof) when the shoe is worn. As another example, a midfoot region of a foot includes the cuboid, navicular, medial cuneiform, intermediate cuneiform and lateral cuneiform bones and the heads of the metatarsal bones. A midfoot element of a shoe is an element having one or more portions located over, under and/or to the lateral and/or medial sides of a wearer's midfoot (or portion thereof) when the shoe is worn. As a further example, a heel region of a foot includes the talus and calcaneus bones. A heel element of a shoe is an element having one or more portions located over, under, to the lateral and/or medial sides of, and/or behind a wearer's heel (or portion thereof) when the shoe is worn. The forefoot region may overlap with the midfoot region, as may the midfoot and heel regions.

Unless indicated otherwise, a longitudinal axis refers to a horizontal heel-toe axis along the center of a shoe and that is roughly parallel to a line that would follow along the second metatarsal and second phalanges of the wearer foot. A transverse axis refers to a horizontal axis across a shoe that is generally perpendicular to a longitudinal axis. A longitudinal direction is parallel (or roughly parallel) to a longitudinal axis. A transverse direction is parallel (or roughly parallel) to a transverse axis. An oblique axis refers to an axis that extends across a shoe and that is not parallel and not perpendicular to either the transverse axis or the longitudinal axis. An oblique direction is parallel (or roughly parallel) to an oblique axis. It will be appreciated that multiple oblique axes between the longitudinal axis and the transverse axis may extend across the shoe.

Referring to FIG. 1, a bottom view of a portion of an exposed bottom surface 100 of an example embodiment of a midsole 101 of an articulated sole structure 102 is shown. For clarity, only some of the elements described below are labeled in FIG. 1. The articulated sole structure 102 includes multiple sipes 104 formed in the bottom surface 100 and extending upward into the articulated sole structure. The sipes 104 are arranged on the midsole 101 so as to form a hexagonal pattern across at least a portion of the bottom surface 100 of the midsole of the articulated sole structure 102. As seen in FIG. 1, the sipes 104 formed in the bottom surface 100 of the midsole 101 include multiple sipes 104*a* that are transversely oriented and extend in a generally transverse direction. The transversely oriented sipes 104*a* may thus be referred to as transverse sipes. The sipes 104 formed in the bottom surface 100 of the midsole 101 also include sipes 104*b-c* that are obliquely oriented relative to the transverse sipes 104*a* and extend in a generally slantwise direction relative to the transverse sipes. The obliquely oriented sipes 104*b-c* may thus be referred to as oblique sipes. A forward end 106 of an oblique sipe 104*b* or 104*c* may be disposed towards the front of the articulated sole structure 102 and towards either the medial side or the lateral side of the articulated sole structure. Accordingly, the oblique sipes 104*b-c* may also be identified based on the disposition of their respective forward ends 106. In this regard, oblique sipes 104*b-c* may include medially-disposed oblique sipes 104*b* and laterally-disposed oblique sipes 104*c*.

A sipe 104 may have a length between about 10 mm to about 12 mm, and in some example embodiments the length of a sipe may be about 11 mm. The length of the sipes 104 may be about the same so as to form a hexagonal pattern on the articulated sole structure 102. A sipe 104 may also have a width of about 1 mm. The depth of a transverse sipe 104*a* or an oblique sipe 104*b-c* may vary depending on which region of the articulated sole structure 102 the sipe is formed in, e.g., the forefoot region, the midfoot region, or the heel region. In some example embodiments, the thickness of the articulated sole structure 102 may be greater at the heel region relative to the thickness of the articulated sole structure at the forefoot region. In these example embodiments, sipes 104 formed in the heel region may thus be deeper relative to sipes formed in the forefoot region of the sole structure 102. Moreover, the depth of a transverse sipe 104*a* or an oblique sipe 104*b-c* may vary from one end of the sipe to another end of the sipe such that one end of the sipe is shallower or deeper relative to the other end of the sipe. Varying the depth of the sipes 104 may provide more or less flexibility when the articulated sole structure is flexed about an axis. The depth of the sipes will be discussed in further detail below.

The sipes 104 may merge with one another such that the sipes are contiguous with one another. As seen in FIG. 1, for example, at least one end of a transverse sipe 104*a* may merge with one or more oblique sipes 104*b-c*. Likewise, at least one end of an oblique sipe 104*b* or 104*c* may merge with a transverse sipe 104*a* or another oblique sipe. Moreover, the transverse sipes 104*a* and the oblique sipes 104*b-c* may be arranged to form a hexagonal pattern on the bottom surface 100 of the midsole 101 of the articulated sole structure 102 as shown by way of example in FIG. 1. The arrangement of the transverse sipes 104*a* and the oblique sipes 104*b-c* may thus define one or more sole elements 112 having a generally hexagonal shape. The sole elements 112 having a generally hexagonal shape may thus be referred to as hexagonal sole elements. The sipes 104 defining the hexagonal sole elements 112 may therefore correspond to the respective edges of the hexagonal sole elements. Various hexagonal sole elements 112 defined by the sipes 104 are highlighted in FIG. 1 through the use of a solid bold outline for the edges of the hexagonal sole elements.

Furthermore, the junction of a transverse sipe 104*a* and an oblique sipe 104*b* or 104*c* may correspond to a vertex of a hexagonal sole element 112. A vertex of a hexagonal sole element 112 may also correspond to the junction of an oblique sipe 104*b* or 104*c* with another oblique sipe or to the junction of a transverse sipe 104*a* and a pair of oblique sipes. Stated differently, one pair of transverse sipes 104*a* and two pairs of oblique sipes 104*b* and 104*c* may be arranged in a generally hexagonal configuration in the articulated sole structure 102 so as to define a hexagonally-shaped sole element 112 in the articulated sole structure.

The articulated sole structure 102 may include multiple discrete hexagonal sole elements 112 respectively defined by the transverse sipes 104*a* and the oblique sipes 104*b-c*. The hexagonal sole elements 112 may extend downward from a spanning portion (discussed further below) of the articulated sole structure 102. A hexagonal sole element 112 may be positioned next to one or more adjacent hexagonal sole elements. Hexagonal sole elements 112 that are adjacent to one another may share an edge defined by one of the transverse sipes 104*a* or one of the oblique sipes 104*b-c*. Hexagonal sole elements 112 that are adjacent to one another may also share one or more vertices defined by the junction of transverse sipes 104*a* and/or oblique sipes 104*b-c*. As shown by way of example in FIG. 1, a hexagonal sole element 112 may be adjacent to multiple hexagonal sole elements and therefore share multiple edges and vertices with adjacent hexagonal sole elements respectively.

A hexagonal sole element 112 of the type shown by way of example in FIG. 1 may have an edge-to-edge diameter of about 18 mm to about 20 mm, and in some example embodiments the edge-to-edge diameter may be about 19 mm. A hexagonal sole element 112 may also have a vertex-to-vertex diameter of about 21 mm to about 23 mm, and in some example embodiments the vertex-to-vertex diameter may be about 22 mm. The edge-to-edge diameter refers to a straight line extending from one edge of the hexagonal sole element 112 to an opposite edge of the hexagonal sole element and passing through the center of the hexagonal sole element. Likewise, the vertex-to-vertex diameter refers to a straight line extending from one vertex of the hexagonal sole element 112 to an opposite vertex of the hexagonal sole element and passing through the center of the hexagonal sole element. Additionally, the length of the edges of a hexagonal sole element 112 may be about the same such that the hexagonal sole element resembles a regular hexagon.

Moreover, the transverse sipes 104*a* and the oblique sipes 104*b-c* may be arranged to define one or more sole elements 114 wherein the sole element does not have a hexagonal shape but rather an alternative polygonal shape. Sole elements 114 that do not have a generally hexagonal shape may thus be referred to as non-hexagonal sole elements. One or more portions of a non-hexagonal sole element 114 may, however, resemble a portion of a hexagonal sole element 112. Accordingly, non-hexagonal sole elements 114 may share one or more edges and one or more vertices with one or more hexagonal sole elements 112. Sipes 104 defining various non-hexagonal sole elements 114 are also highlighted in FIG. 1 through the use of a dashed bold outline for the edges of the non-hexagonal sole elements. As seen in FIG. 1, a portion of the medial edge 108 or a portion of the lateral edge 110 of the articulated sole structure 102 may also define at least a portion of at least some of the non-hexagonal sole elements 114. Accordingly, at least one edge of a non-hexagonal sole element 114 may be defined by the lateral edge 110 or medial edge 108 of the sole structure 102.

As used herein, a sipe generally refers to a separation between sides of adjacent discrete sole elements. In some cases, a sipe may leave little or no space between the sides of adjacent sole elements when the siped sole structure is unloaded. For example, side faces of adjacent sole elements separated by a narrow sipe may actually be in contact with one another when the sole structure is unloaded, and there may only be space between those faces when the sole structure flexes along the sipe. In other cases, a wider sipe may create a larger gap between sides of adjacent sole elements, and there may be space between those sole element sides in the unloaded sole structure. In still other cases, a sipe may have a portion (e.g., the deepest part of the sipe) in which adjacent sole elements are in contact when the sole structure is unloaded and another portion (e.g., the portion of the sipe near the bottom surface of the midsole) in which there is a groove or other space between adjacent sole element faces in the unloaded sole structure.

Sipes can be formed by molding, e.g., by including blades in a midsole mold corresponding to desired sipe locations. Sipes can also be formed by cutting sipes in a midsole or other sole structure using a knife or other tool. Sipes can also be formed using combinations of molding and cutting operations, as well as by other processes. In some embodiments, thinner sipes may be "knifed" (i.e., cutting with a blade), while wider sipes may be molded into a midsole. In some such embodiments, the molded-in sipes may be located in areas of a shoe where higher stresses may be expected (e.g., at the heel, where a step lands, and at the toe, where step-off occurs). Molded-in sipes may in some cases be more durable than knifed sipes, as all sides of the sipe are exposed to curing conditions and have an outer crust of cured polymer. Conversely, knifed sipes are cut into the midsole after curing. Thus, knifed sipes side edges and their junction with the spanning portion may constitute uncured polymer material that is less durable than cured polymer.

The articulated sole structure 102 may also include multiple discrete lugs 116 distributed across the bottom surface 100 of the midsole 101. Like the hexagonal sole elements 112, some of the lugs 116 may also have a generally hexagonal shape. For example, the lugs 116*a* may have a generally hexagonal shape and may thus be referred to as hexagonal lugs. As seen in FIG. 1, one or more of the hexagonal sole elements 112 may include a hexagonal lug 116*a* formed on or otherwise connected to the lower surface of a hexagonal sole element. The edges of a hexagonal sole element 112 may surround the hexagonal lug 116*a*. A hexagonal lug 116*a* may extend downward from a hexagonal sole element 112. In addition, some of the hexagonal sole elements 112 may include a hexagonal indent 118*a* that circumscribes the hexagonal lug 116*a*, while other hexagonal sole elements may lack a hexagonal indent circumscribing the hexagonal lug. A hexagonal lug 116*a* of the type shown by way of example in FIG. 1 may have an edge-to-edge diameter of about 11 mm to about 13 mm, and in some example embodiments the edge-to-edge diameter may be about 12 mm. A hexagonal lug 116*a* may have a vertex-to-vertex diameter of about 14 mm to about 16 mm, and in some example embodiments the vertex-to-vertex diameter may be about 15 mm. The edges of a hexagonal lug 116*a* may also be about the same size such that the hexagonal lug resembles a regular hexagon. The hexagonal lugs 116*a* may also have a height of about 1 mm to about 3 mm, and in some example embodiments the height of a hexagonal lug may be about 2 mm. The lugs 116 of the articulated sole structure 102 may also include lugs 116*b* that do not have a hexagonal shape but rather an alternative polygonal shape. Accordingly, lugs 116*b* that do not have a hexagonal shape may be referred to as non-hexagonal lugs. The non-hexagonal sole elements 114 may include one or more lugs 116 that include hexagonal lugs 116*a* and non-hexagonal lugs 116*b*. One or more of the non-hexagonal sole elements 114 may also include non-hexagonal indents 118*b* circumscribing non-hexagonal lugs 116*b*. Some of the sole elements 112 and 114 may not include a lug as seen in FIG. 1.

As noted above, FIG. 1 only shows a portion of the bottom surface 100 of a sole structure 102. Other portions of the sole structure 102 not seen in FIG. 1 may include one or more of the features described above including the sipes 104*a-c*, the sole elements 112-114, the lugs 116*a-b*, or the indents 118*a-b*.

Figure 2:
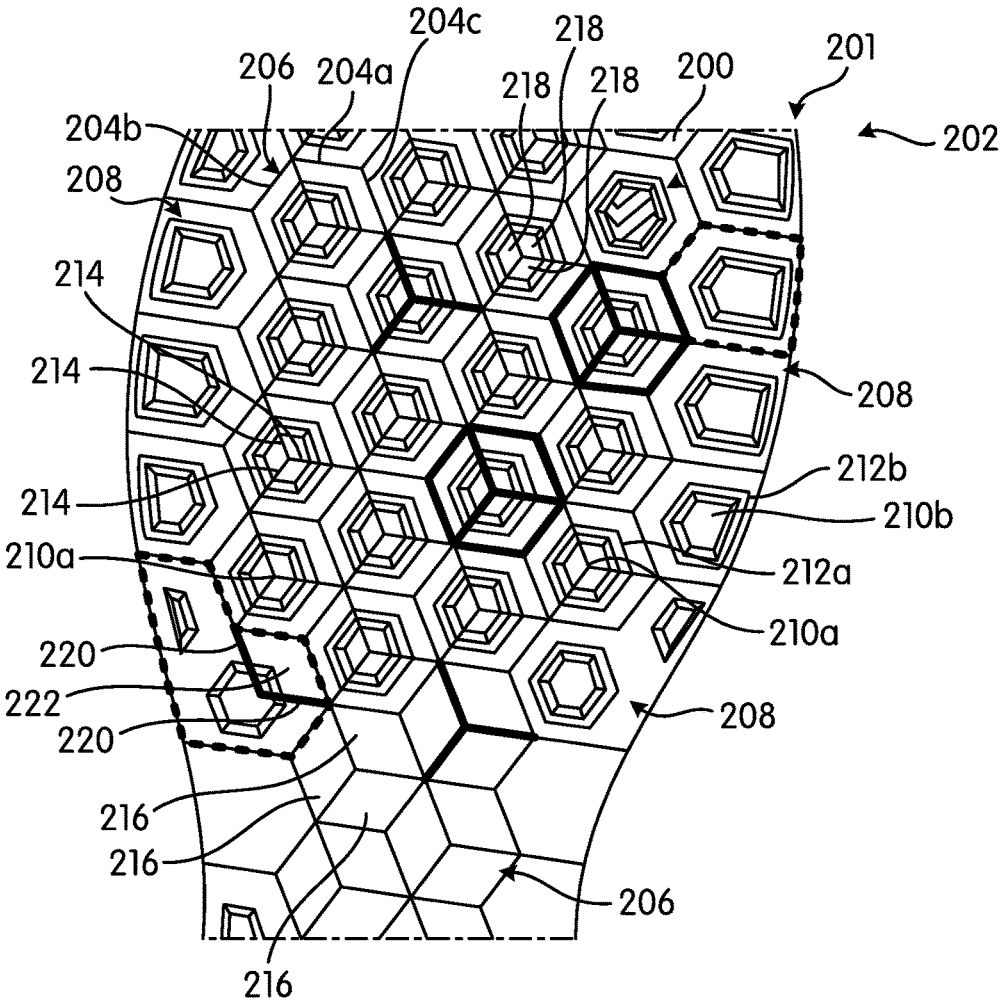
FIG. 2 is a bottom view of a portion of another example of an articulated sole structure according to some embodiments.

Referring now to FIG. 2, a bottom view of a portion of an exposed bottom surface 200 of another example embodiment of a midsole 201 of an articulated sole structure 202 is shown. For clarity, only some of the elements described below are labeled in FIG. 2. Like the example articulated sole structure 102 in FIG. 1, the example articulated sole structure 202 in FIG. 2 includes multiple transverse sipes 204*a* and oblique sipes 204*b-c* formed in the bottom surface 200 that extend upward into the articulated sole structure. The transverse sipes 204*a* and the oblique sipes 204*b-c* of the articulated sole structure 202 in FIG. 2 are also arranged on the bottom surface 200 so as to provide a hexagonal pattern across at least a portion of the bottom surface of the midsole 201. Accordingly, the sipes 204 of the articulated sole structure 202 in FIG. 2 also define multiple discrete sole elements 206 and 208 extending downward from a spanning portion of the articulated sole structure. The sipes 204 in FIG. 2 may have dimensions similar to the sipes 104 discussed above with reference to FIG. 1. The articulated sole structure 202 in FIG. 2 includes sipes 204 defining hexagonal sole elements 206 and non-hexagonal sole elements 208 as described above. Multiple discrete hexagonal sole elements 206 and non-hexagonal sole element 208 are distributed across the bottom surface 200 of the midsole 201 of the sole structure 202 in this example. Some of the hexagonal sole elements 206, in this example, include a hexagonal lug 210*a* as described above. In addition, some of the hexagonal sole elements 206 with a hexagonal lug 210*a* also include a hexagonal indent 212*a* circumscribing the hexagonal lug. Some of the non-hexagonal sole elements 208, in this example, include a non-hexagonal lug 210*b* and may also include a non-hexagonal indent 212*b* circumscribing the non-hexagonal lug. In addition, some of the non-hexagonal sole elements 208, in this example, include multiple lugs 210, e.g., a hexagonal lug 210*a* and a non-hexagonal lug 210*b*. Furthermore, some of the sole elements 206 or 208 may include a lug 210 and may not include an indent circumscribing the lug, and some of the sole elements may not include a lug or an indent as seen in FIG. 2.

The articulated sole structure 202 in FIG. 2 further includes multiple sipes 214 that extend upward into the articulated sole structure and that subdivide some of the hexagonal sole elements 206 into multiple hexagonal sole element portions 216. As seen in FIG. 2, these additional sipes 214 may extend from a vertex of a hexagonal sole element 206 to the center of the hexagonal sole element. Accordingly, these additional sipes 214 may be referred to as radial sipes. A radial sipe 214 may merge with a transverse sipe 204*a* and/or an oblique sipes 204*b-c* at a junction of the sipes at a vertex of a hexagonal sole element 206. Radial sipes 214 may also merge with one another at a junction of the radial sipes near the center of a hexagonal sole element 206 as shown by way of example in FIG. 2. Various radial sipes are highlighted in FIG. 2 through the use of bold lines within some of the hexagonal sole elements 206.

A hexagonal sole element 206 may include three radial sipes 214 uniformly distributed around the center of the hexagonal sole element. Stated differently, if the vertices of a hexagonal sole element 206 are labeled from 1-6 around the hexagonal sole element, then the three radial sipes 214 may respectively extend from the first, third, and fifth vertices to the center of the hexagonal sole element (or from the second, fourth, and sixth vertices). As seen in FIG. 2, radial sipes 214 arranged in this manner may subdivide a hexagonal sole element 206 into three adjacent diamond-shaped sole element portions 216. The diamond-shaped sole element portions 216 may be generally uniform such that the diamond-shaped sole element portions are generally the same size. Furthermore, the radial sipes 214 may also subdivide the hexagonal lug 210*a* of a hexagonal sole element 206. As seen in FIG. 2, the radial sipes 214 may divide a hexagonal lug 210*a* into three adjacent diamond-shaped lug portions 218. Accordingly, a diamond-shaped sole element portion 216 may include one of the diamond-shaped lug portions 218. The radial sipes 214 may have a length of about 10 mm to about 12 mm, and in some example embodiments the length of the radial sipes maybe 11 mm, i.e., about half the vertex-to-vertex diameter of the hexagonal sole element. As also seen in the articulated sole structure 202 of FIG. 2, sipes 220 may similarly subdivide a non-hexagonal sole element 208 such that the non-hexagonal sole element includes at least one diamond-shaped sole element portion 222. The sipes 220 may also subdivide a hexagonal lug of a non-hexagonal sole element 208 such that the non-hexagonal sole element also includes a diamond-shaped lug portion 222 as shown by way of example in FIG. 2.

As also noted above, only a portion of the bottom surface 200 of the sole structure 202 is shown in FIG. 2. Other portions of the sole structure 202 not shown in FIG. 2 may include one or more of the features described above including the sipes 204*a-c*, the sole elements 206-208, the lugs 210*a-b*, the indents 212*a-b*, the radial sipes 214, the diamond-shaped sole element portions 216, or the diamond-shaped lug portions 218.

Figure 3:
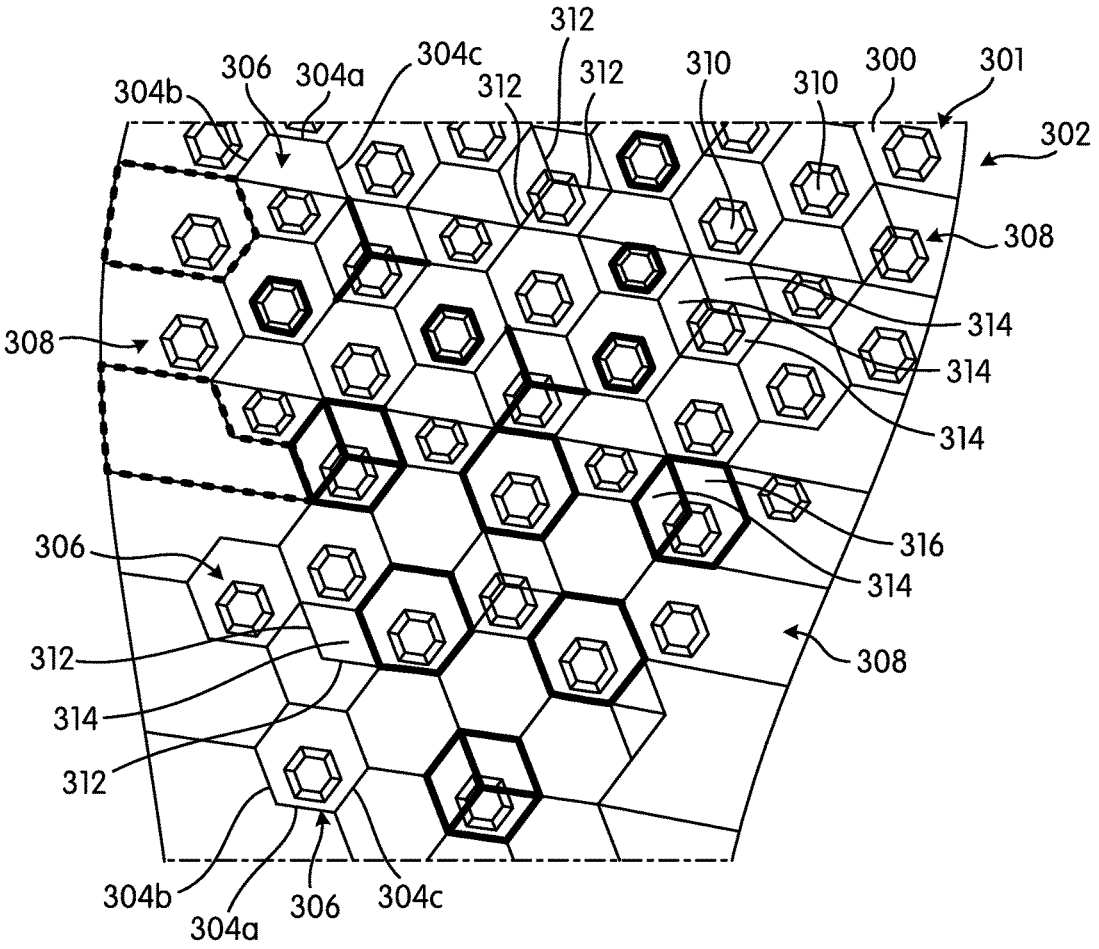
FIG. 3 is a bottom view of a portion of a further example of an articulated sole structure according to some embodiments.

Referring to FIG. 3, a bottom view of a portion of an exposed bottom surface 300 of an additional example embodiment of a midsole 301 of an articulated sole structure 302 is shown. As before, only some of the elements described below are labeled in FIG. 3 for the sake of clarity. As seen in FIG. 3, the articulated sole structure 302 in this additional example embodiment includes multiple transverse sipes 304*a* and oblique sipes 304*b-c* formed and extending upward into the articulated sole structure. The sipes 304 similarly form a hexagonal pattern on the bottom surface 300 of the midsole 301 of the articulated sole structure 302. The transverse sipes 304*a* and the oblique sipes 304*b-c* likewise form multiple hexagonal sole elements 306 and non-hexagonal sole elements 308 extending downward from the articulated sole structure 302. Some of the sipes 304 defining hexagonal sole elements 306 of the sole structure 302 are highlighted in FIG. 3 using solid bold outlines for the edges of the hexagonal sole elements. Similarly, some of the sipes 304 defining the non-hexagonal sole elements 308 are highlighted in FIG. 3 using dashed bold outlines for the edges of the non-hexagonal sole elements. The midsole 301 in this embodiment also includes multiple discrete hexagonal lugs 310 distributed across its bottom surface 300. Some of the hexagonal sole elements 306 and some of the non-hexagonal sole elements 308, in this example, also include individual hexagonal lugs 310 formed on or otherwise secured to the lower surface of the sole element. Some of the hexagonal sole elements 306 and non-hexagonal sole elements 308 may not include a hexagonal lug as seen in FIG. 3.

In the example articulated sole structure 302 of FIG. 3, the sipes 304 may be shorter relative to the sipes 104 and 204 respectively shown by way of example in FIGS. 1-2. Accordingly, the hexagonal sole elements 306 of the sole structure 302 of FIG. 3 are smaller relative to the hexagonal sole elements 112 and 206 respectively shown by way of example in FIGS. 1-2. A sipe 304 corresponding to an edge of a hexagonal sole element 306 may have a length of about 4 mm to about 6 mm and in some example embodiments the length of a sipe may be about 5 mm. Accordingly, a hexagonal sole element 306 may have a vertex-to-vertex diameter of about 11 mm to about 13 mm and an edge-to-edge diameter of about 8 mm to about 10 mm. In some example embodiments, the vertex-to-vertex diameter of a hexagonal sole element 306 may be about 12 mm, and the edge-to-edge diameter of a hexagonal sole element may be about 9 mm. Furthermore, the hexagonal lugs 310 may be smaller relative to the hexagonal lugs 116*a* and 210*a* shown by way of example in FIGS. 1-2. A hexagonal lug 310 may have a diameter of about 4 mm to about 6 mm, and in some example embodiments the diameter of the hexagonal lug may be abut 5 mm.

The example articulated sole structure 302 in FIG. 3 also includes individual hexagonal sole elements 306 having radial sipes 312. Some of the hexagonal sole elements 306 include three radial sipes 312 while other hexagonal sole elements only include two radial sipes 312. Some of the radial sipes 312 are again highlighted in FIG. 3 through the use of solid bold lines within some of the hexagonal sole elements 306. The radial sipes 312 may similarly subdivide a hexagonal sole element 306 into one or three diamond-shaped sole element portions 314. As seen in FIG. 3, a hexagonal sole element having only two radial sipes 312 may include one diamond-shaped sole element portion 314 and one concave hexagon sole element portion 316. The number of diamond-shaped sole element portions 314 may depend on the number of radial sipes 312 included in a hexagonal sole element 306. The radial sipes 312 shown in the example articulated sole structure 302 of FIG. 3 are also smaller relative to the radial sipes 214 shown by way of example in FIG. 2. Accordingly, the length of a radial sipe 314 may be about 4 mm to about 6 mm, and in some example embodiments the length of the radial sipe may be about 5 mm, i.e., about half of the vertex-to-vertex diameter of a hexagonal sole element 306.

It will be appreciated that by merging the sipes of the articulated sole structures in FIGS. 1-3, the sole elements and sole element portions may separate and move away from one another when the articulated sole structure is flexed about a transverse axis, a longitudinal axis, and/or an oblique axis, e.g., as a wearer walks, runs, and performs other types of movements. The flexibility of an articulated sole structure may depend on various factors related to the articulated sole structure. Factors affecting the flexibility of an articulated sole structure may include: the total number, dimensions, and shape of the sole elements; as well as the total number, dimensions, and orientation of the sipes that define the sole elements.

The thickness of the articulated sole structures described herein may vary across the forefoot region, midfoot region, and heel region. For example, an articulated sole structure maybe thicker in the heel region relative to the forefoot region. As a result, the offset height provided by the sole structure may depend on the thickness of the sole structure at the forefoot region and at the heel region. The offset height refers to the difference in height of the forefoot of a foot relative to the heel of the foot when wearing the shoe. When barefoot, the offset height of the foot is zero since both the forefoot and the heel contact the ground. It will thus be appreciated that the offset height may be greater than zero when wearing a shoe having a sole structure that is thicker in the heel region of the shoe relative to the forefoot region.

In some example embodiments of the articulated sole structure described herein, the offset height may be between around 4 mm-8 mm. A relatively small offset height (e.g., 4 mm) may correspond to a relatively small difference in thickness between the forefoot region of a sole structure and the heel region. A relatively large offset height (e.g., 8 mm) may correspond to a relatively large difference in thickness between the forefoot region of a sole structure and the heel region. The smaller the offset height, the more closely the articulated sole structure may impart a feeling or sensation of being barefoot.

The articulated sole structures described herein have a flexible construction that complements the natural motion of the foot in order to impart a sensation or feeling of being barefoot while walking, running, or performing other types of movements. Unlike being barefoot, however, the articulated sole structures described herein also attenuate ground reaction forces and absorb energy to cushion the foot and decrease overall stress upon the foot. In other words, the articulated sole structures described herein include elements and features that impart flexibility, stability, and cushioning effects. Accordingly, the sipes may have a depth sufficient to impart flexibility to the sole structure, and the portion of the sole structure above the sipes and including a spanning portion may have a thickness sufficient to provide cushioning to the foot of the wearer.

An articulated sole structure having one or more of the features described above with reference to FIGS. 1-3 may provide other functional advantages to a wearer of a shoe incorporating the articulated sole structure. One advantage is the multiple degrees of flexibility-in this case six degrees of flexibility-provided by the six sides of the hexagonal sole elements. A hexagonal sole element with its six sides may advantageously provide more degrees of flexibility relative to a sole element having fewer sides, e.g., a square-shaped sole element only having four sides and thus only four degrees of flexibility.

The number of sipes and the size of the sole elements may provide another advantage with respect to the flexibility of an articulated sole structure. It will be appreciated with benefit of this disclosure that the flexibility of an articulated sole structure may increase as the total number of sipes and sole elements defined by those sipes increases. Accordingly, an articulated sole structure having relatively more sipes and thus relatively more sole elements may be relatively more flexible than an articulated sole structure having relatively fewer sipes and thus relatively fewer sole elements.

The shape of the lugs may also provide a functional advantage to a wearer of a shoe incorporating the articulated sole structure. In general, the lugs may provide cushioning effects as the shoe impacts the ground when a wearer walks, runs, or performs other types of movement. When the shoe impacts the ground, a lug may be pushed upward into the sole structure. It will be appreciated that the direction of the impact may depend on how the shoe strikes the ground, e.g., in a longitudinal direction, transverse direction, and/or oblique direction. A hexagonally-shaped lug may thus provide multiple sides that impact the ground—in this case six sides—at which the lug may strike the ground and be pushed up into the sole structure. A hexagonal lug with its six sides may therefore advantageously provide more impact locations relative to a lug having fewer sides, e.g., a square-shaped lug only having four sides and thus only four impact locations.

Figure 4A:
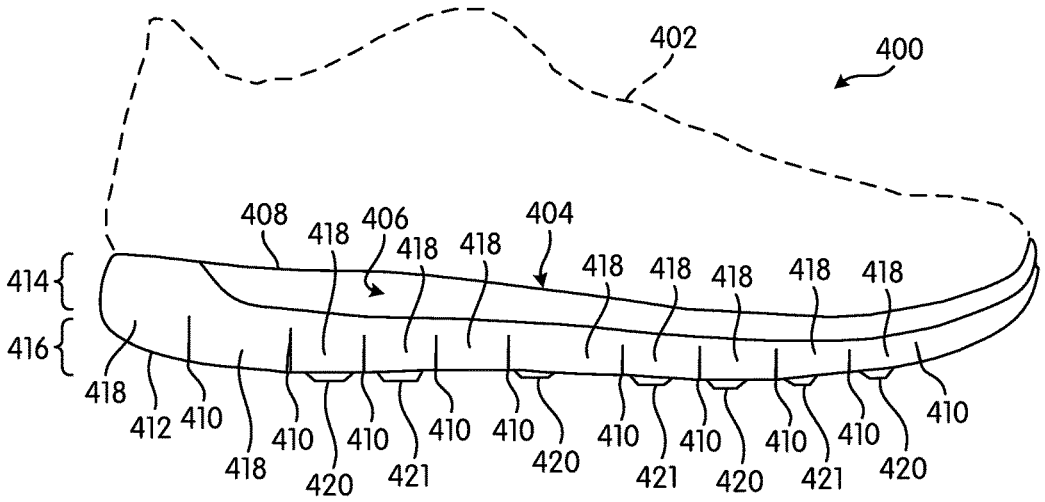
FIG. 4A and FIG. 4B are lateral side and medial side views, respectively, of a shoe according to some embodiments.
Figure 4B:
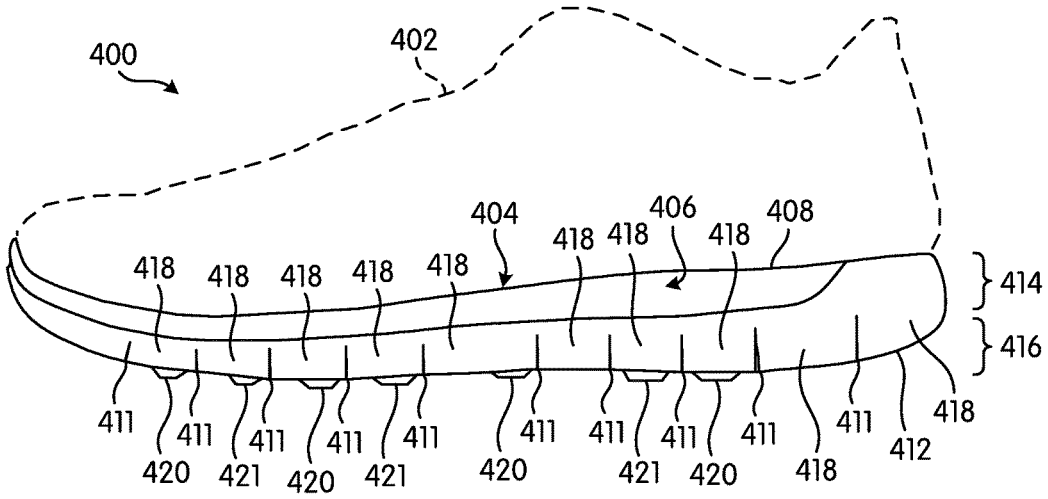

Referring now to FIG. 4A, a lateral side view of an example of an embodiment of a shoe 400 having various aspects described above is shown. FIG. 4B is a medial side view of the shoe 400 of FIG. 4A. For clarity, only some of the elements described below are labeled in FIGS. 4A-B. The shoe 400 includes an upper 402. The upper 402 creates an interior configured to receive a foot of a shoe wearer. In some embodiments, the upper 402 can be similar to uppers described in commonly-owned U.S. Pat. No. 6,990,755, entitled "Article of Footwear with a Stretchable Upper and an Articulated Sole Structure," which is incorporated by reference in its entirety herein. Shoes according to various embodiments can include sole structures such as those described herein in combination with any of various types of uppers. Because the details of such uppers are not pertinent to understanding the sole structures disclosed herein, the upper 402 is shown generically in FIGS. 4A-B. The upper 402 may include a lasting element (e.g., a Strobel). The lasting element may be stitched to edges of upper 402 along a seam, with the seam located near a periphery of a footbed. An insole can be positioned adjacent to the top surface of the lasting element within the interior. The insole may contact the bare or socked plantar surface of the wearer foot along the entire length of the foot. The insole may be compressible and/or have an orthotic shape to conform to a wearer foot.

In the embodiment of the shoe 400, the sole structure 404 primarily comprises a single-piece midsole 406. A top surface 408 of the midsole 406 may be bonded to the underside of the lasting element and may border portions of the upper 402 located outside of the seam. The midsole 406 protects the foot of a shoe wearer from ground surface material that might puncture or otherwise injure the skin on the underside of the foot. The midsole 406 may also provide cushioning by attenuating ground reaction forces and absorbing energy when a wearer of the shoe 400 walks, runs, or performs other types of movements. Suitable materials for the midsole 406 can include any of various polymer foams utilized in conventional footwear midsoles, including but not limited to ethylvinylacetate (EVA), thermoplastic polyurethane (TPU), and polyurethane foams. The midsole 406 may also be formed from a relatively lightweight polyurethane foam having a specific gravity of approximately 0.22, as manufactured by Bayer AG under the BAYFLEX trademark.

The midsole 406 has an articulated construction that imparts relatively high flexibility and articulation. The flexible structure of the midsole 406 is configured to complement the natural motion of the foot during walking, running or other movements, and may impart a feeling or sensation of barefoot running. In contrast with barefoot running, however, the midsole 406 attenuates ground reaction forces and absorbs energy to cushion the foot and decrease the overall stress upon the foot. Furthermore, and as described herein, the midsole 406 includes a plurality of sipes 410-411 that accommodate foot motion. Moreover, it will be recognized that the bottom surface of some midsoles may traditionally be covered by the outsole of a sole structure. It will be appreciated with the benefit of this disclosure, however, that at least a portion of the bottom surface 412 of the midsole 406 of the sole structure 404 (and the sipes formed in the bottom surface) may be exposed and come into contact with the ground as a user walks, runs, or performs other types of movements. As described in further detail below, the sole structure 404 may include various outsole elements that cover a portion of the bottom surface 412 of the midsole 406, e.g., at high-impact areas in the heel region and forefoot region of the sole structure.

The midsole 406 includes a spanning portion 414 and an articulated portion 416. The precise boundaries of spanning portion 414 and articulated portion 416 are only approximately indicated in FIGS. 4A-B. The spanning portion 414 includes the portion of the midsole 406 above sipes 410-411. The articulated portion 416 includes multiple discrete sole elements 418 that are defined by the sipes 410-411 (and by other sipes described below). The sipes 410-411 (as well as the other sipes described below) extend upward into the articulated portion 416 from the bottom surface 412 of the articulated portion. The sole elements 418 defined by the sipes extend downward from the spanning portion 414 of the sole structure 404. The sole elements 418 may be similar to the non-hexagonal sole elements described above with reference to FIG. 1. The articulated portion 416 also includes multiple lugs 420 and 421 that are formed from or otherwise connected to and that extend downward from the sole elements 418. The lugs may be hexagonal lugs 420 or non-hexagonal lugs 421 and similar to the lugs 116*a-b* described above with reference to FIG. 1. Only some of the sipes, sole elements, and lugs can be seen in FIGS. 4A-B.

Figure 4C:
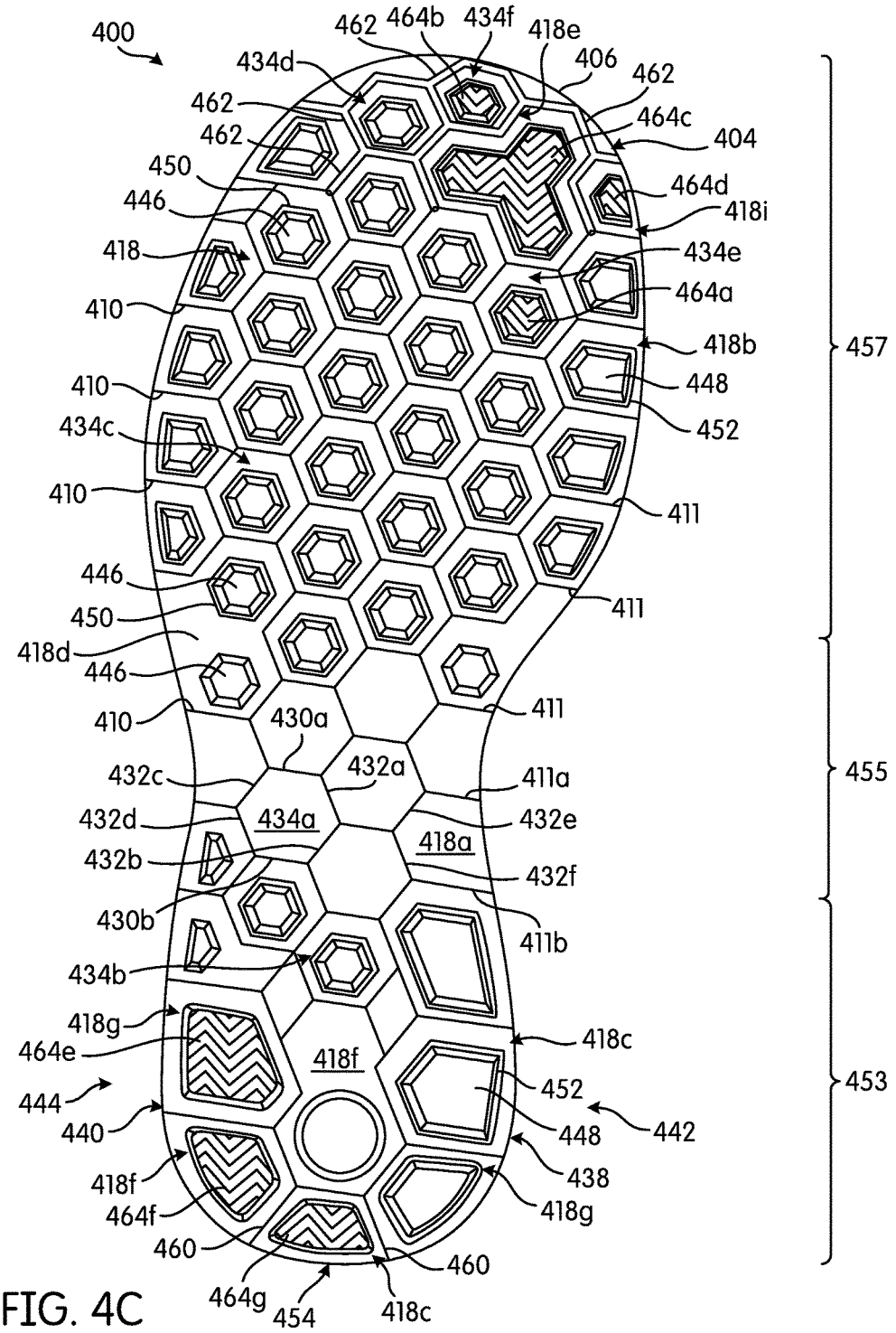
FIG. 4C is a bottom view of the shoe of FIG. 4A and FIG. 4B.

All of the sipes, sole elements, and lugs can be seen in FIG. 4C, a bottom view of the shoe 400 showing the exposed bottom surface of the example midsole 406. Like FIGS. 4A-B, only some of the elements described below are labeled in FIG. 4C. At least a portion of the bottom surface of the midsole 406, in this example, may be similar to the portion of the articulated sole structure 102 described above with reference to FIG. 1. In particular, the midsole 406 includes sipes that include transverse sipes 430 and oblique sipes 432 merged together to form a hexagonal pattern on the bottom surface of the midsole 406 of the sole structure. The sipes 430 and 432 define numerous discrete sole elements 434 and 418 by exposing sides of those elements. This permits those discrete sole elements 434 and 418 to move away from one another when the midsole 406 is flexed about an axis. For example, a front medial side of a hexagonal sole element 434*a* is exposed by the oblique sipe 432*a*, and a rear medial side of the hexagonal sole element is exposed by the oblique sipe 432*b*. A front lateral side of the hexagonal sole element 434*a* is exposed by a front lateral oblique sipe 432*c*, and a rear lateral side of the hexagonal sole element is exposed by a rear lateral oblique sipe 432*d*. The front and rear sides of the hexagonal sole element 434*a* are exposed by a front transverse sipe 430*a* and a rear transverse sipe 430*b* respectively. The exposed sides of a sole element 434 or 418 allows the sole element to separate from the sides of adjacent sole elements when a wearer steps on an uneven surface and/or when the wearer dorsiflexes, pronates, supinates or otherwise moves the foot. Other sipes 430 and 432 of the articulated sole structure 404 may similarly expose the sides of other hexagonal sole elements 434 and non-hexagonal sole elements 418.

As seen in FIG. 4C and as described above, the sipes 430 and 432 may define multiple hexagonal sole elements 434 as well as multiple non-hexagonal sole elements 418. The sipes 430 and 432 may thus correspond to the edges of the hexagonal sole elements 434 and to at least some of the edges of the non-hexagonal sole elements 418. Some of the non-hexagonal sole elements 418 may also be defined by either the medial edge 438 or lateral edge 440 of the articulated sole structure 404. In this regard, a portion of the medial edge 438 may correspond to one of the edges of some of the non-hexagonal sole elements 418 located at the medial side 442 of the sole structure 404. Likewise a portion of the lateral edge 440 may correspond to one of the edges of some of the non-hexagonal sole elements 418 located at the lateral side 444 of the sole structure 404. In this example, some of the sole elements 434 and 418 include one or more lugs 420 or 421 while other sole elements do not include a lug. Some of the sole elements 434 or 418 that include a lug 420 or 421, in this example, also include an indent 450 or 452 circumscribing the lug. Some of the sole elements 434 or 418 that include a lug 420 or 421, however, do not include an indent circumscribing the lug in this example. As also seen in the example articulated sole structure 404 of FIG. 4C, the lugs 420 and the indents 450 have a hexagonal shape while the lugs 421 and the indents 452 have an alternative polygonal shape, e.g., a non-hexagonal shape.

The embodiment of the sole structure 404 of FIG. 4C includes hexagonal sole elements 434 that are located in a region that extends from the heel region 453 of the sole structure, through the midfoot region 455 of the sole structure, and through the forefoot region 457 of the sole structure to a forward end of the forefoot region. The non-hexagonal sole elements 418 are located along the medial side 442, lateral side 444, and around the rearmost end 454 of the heel region 453 of the articulated sole structure 404. A non-hexagonal sole element 418*e* is also located in the frontmost medial forefoot region 457 of the articulated sole structure 404, and a non-hexagonal sole element 418*f* is also located near the center of the heel region 453 of the articulated sole structure in FIG. 4C.

In the articulated sole structure 404 of FIG. 4C, sipes 411 may extend in a transverse direction from the medial edge 438 of the sole structure toward the lateral edge 440 of the sole structure and may thus be referred to as medial sipes. Some of the medial sipes 411 may respectively extend from the medial edge 438 of the sole structure 404 to a vertex of a hexagonal sole element 434. Similarly, sipes 410 may also extend in a transverse direction from the lateral edge 440 of the sole structure 404 toward the medial edge 438 of the sole structure and may thus be referred to as lateral sipes. Some of the lateral sipes 410 may also respectively extend from the lateral edge of the sole structure 404 to a vertex of a hexagonal sole element 434. The medial sipes 411 and lateral sipes 410 may correspond to the respective sipes 410 shown in the medial and lateral side views of FIGS. 4A-B. As seen in FIG. 4C, the medial sipes 411 and lateral sipes 410 of the sole structure 404 may define respective portions of non-hexagonal sole elements 418 and may thus correspond to respective edges of non-hexagonal sole elements. For example, the non-hexagonal sole element 418*a* may have its front side, rear side, front lateral side, and rear lateral side respectively exposed by medial sipes 411*a-b* and by oblique sipes 432*e-f* A pair of oblique sipes 460 also extend in an oblique direction from the rear edge of the articulated sole structure 404 and into the heel region 453 to define non-hexagonal sole elements 418*c* and 418*f-g* around the rearmost end 454 of the heel region 453 of the articulated sole structure.

The articulated sole structure 404 in FIG. 4C, also includes grooves 462 that define at least a portion of various hexagonal sole elements 434 and non-hexagonal sole elements 418 near the front end of the forefoot region 457 of the sole structure. Grooves 462 may differ from sipes 430 and 432 in that a groove may be wider and shallower relative to a sipe. A groove 462 may also provide less flexibility relative to a sipe when the sole structure 404 is flexed about an axis. Like sipes, however, a groove 462 may also correspond to an edge of a hexagonal sole element 434 or non-hexagonal sole element 418.

Multiple discrete lugs 420 and 421 are distributed across the articulated sole structure 404 of FIG. 4C. As described above, the lugs may include lugs 420 having a hexagonal shape and lugs 421 having an alternative polygonal shape, e.g., a non-hexagonal shape. A sole element 434 or 418 may include a lug 420 or 421 such that the edges of the sole element surround the lug. Some of the sole elements may include multiple lugs. For example, non-hexagonal sole element 418*d*, in this example, includes multiple hexagonal lugs 420. Additionally, a sole element 434 or 418 may include an indent 450 or 452 that circumscribes the lug. Some of the sole elements 434 or 418, however, may not include an indent that circumscribes a lug of the sole element as shown by way of example in FIG. 4C.

As described above, the lugs 420 and 421 may provide traction and cushioning effects when a user walks, runs, or performs other activities while wearing the shoe 400 that incorporates the articulated sole structure 404. Accordingly, the lugs 420 and 421 may be located in regions of the sole structure 404 that typically contact the ground, e.g., the forefoot region 457 and the heel region 453 of the sole structure. As seen in FIG. 4C, the lugs 420 and 421 may be located in a region extending forward from a rear end of the forefoot region 457 to a front end of the forefoot region and extending across the forefoot region between the lateral edge 440 and the medial edge 438. The articulated sole structure 404 in FIG. 4C may also include lugs 420 and 421 located in a region near a front end of the heel region 453 and extending across the front end of the heel region between the lateral edge 440 and the medial edge 438 and along the medial edge of the sole structure in the heel region. Some of the sole elements 434 and 418 may not include a lug. For example, the midfoot region 455 of the articulated sole structure 404 may contact the ground less frequently relative to the forefoot region 457 and the heel region 453. Accordingly, some of the sole elements 434 and 418 located in the midfoot region 455 of the articulated sole structure 404 do not include a lug.

One or more discrete sole elements 434 or 418 may further include an outsole element 464 embedded in or otherwise secured to its lower surface. Such outsole elements 464 may provide increased wear resistance at high-impact areas of the sole structure 404. An outsole element 464 may extend away from a sole element 434 or 418. In the articulated sole structure 404 of FIG. 4C, outsole elements 464 are located in regions extending across at least a portion of the forefoot region 457 and a region extending across at least a portion of the heel region 453. In particular, the outsole elements 464, in this example, are respectively located on three of the laterally-positioned sole elements 418*c* and 418*f-h* in the heel region 453. Outsole elements 464 are also located on four of the medially-positioned sole elements 434*e-f*, 436*e*, and 418*i* in the frontmost forefoot region 457 of the sole structure 404. Some of the outsole elements 464*a-b* may have a hexagonal shape resembling a hexagonal lug 420, and some of the outsole elements 464*c-g* may have an alternative polygonal shape, e.g., a non-hexagonal shape. Suitable materials for outsole elements 464 can include any of various conventional rubber materials utilized in footwear outsoles (e.g., carbon black rubber compound).

In some embodiments, the depth of the sipes 410-411, 430-432, and 460 (as a percentage of sole structure thickness) is maximized, and the thickness of the spanning portion 414 above the sipes is minimized so as to reduce the force needed to flex the sole structure 404 along the sipes and to separate adjacent sole elements 434 and 418. The ratio of sipe depth to the thickness of the spanning portion 414 above the sipes, however, may not exceed a predetermined maximum value in some example embodiments in order to avoid compromising the structural integrity of the sole structure 404. Example sipe depths are discussed in further detail below with reference to FIGS. 8A-F.

Other embodiments of an articulated sole structure may incorporate one or more of the features described above. It will thus be appreciated that alternative embodiments incorporating various features described above will still be within the scope of the claimed subject matter.

Figure 5A:
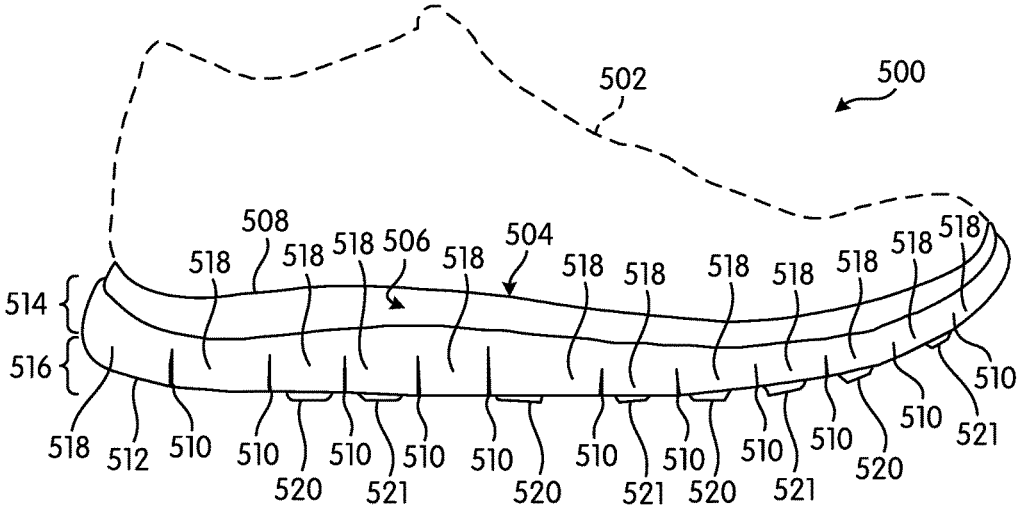
FIG. 5A and FIG. 5B are lateral side and medial side views, respectively, of a shoe according to some embodiments.
Figure 5B:
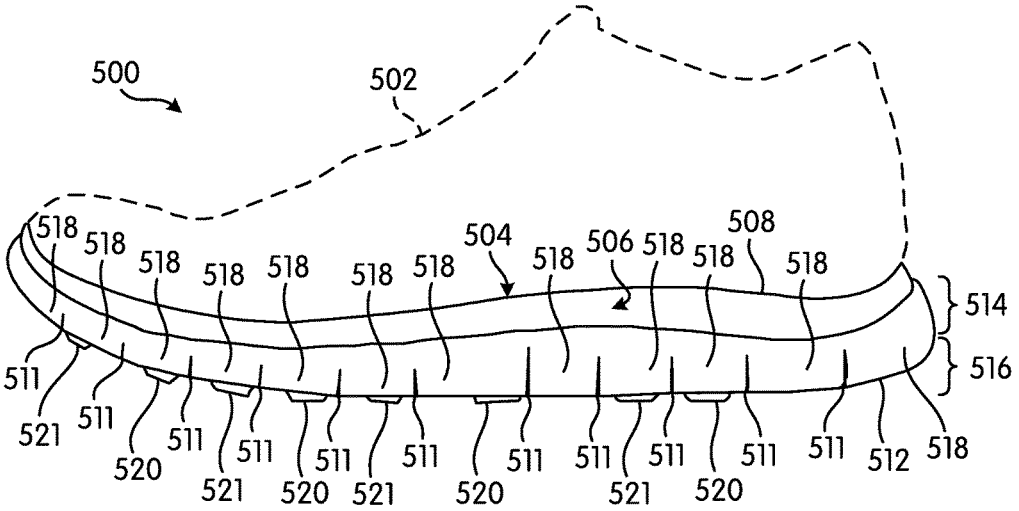

FIG. 5A is a lateral side view of a shoe 500 according to at least some additional embodiments. FIG. 5B is a medial side view of the shoe 500 in FIG. 5A. For clarity, only some of the elements described below are labeled in FIGS. 5A-B. Like the shoe 400 described above in reference to FIGS. 4A-B, the shoe 500 includes an upper 502. As previously indicated, shoes according to various embodiments can include sole structures such as those described herein in combination with any of various types of uppers. Accordingly, the upper 502 is also shown generically in FIGS. 5A-B using a broken line. The upper 502 may include a lasting element and have a construction similar to that described in connection with the upper 402 and shown in FIGS. 4A-B. Shoe 500 includes a sole structure 504, which sole structure primarily comprises a single-piece midsole 506. A top surface 508 of midsole 506 may be bonded to the underside of the upper lasting element and to border portions of upper 502. The midsole 506 protects the foot of a shoe wearer from ground surface material. The midsole 506 also provides cushioning by attenuating ground reaction forces and absorbing energy when a wearer of the shoe 500 walks, runs, and performs other types of movements. Suitable materials for the midsole 506 can include any of various materials described above in connection with the midsole of FIGS. 4A-C.

The midsole 506 also has an articulated construction that imparts relatively high flexibility and articulation and that includes a plurality of sipes 510-511 accommodating foot motion. As previously described, at least a portion of the bottom surface 512 of the midsole 506 may be exposed while other portions of the bottom surface of the midsole may be covered by a portion of an outsole or an outsole element. Referring to FIGS. 5A-B, the midsole 506 includes a spanning portion 514 and an articulated portion 516. The precise boundaries of the spanning portion 514 and the articulated portion 516 are only approximately indicated in FIGS. 5A-B. The spanning portion 514 includes the underfootbed portion of midsole 506 above the sipes 510-511. The articulated portion 516 includes multiple discrete sole elements 518 that are defined by the sipes 510-511 (and by other sipes described below). The sipes 510-511 (and the other sipes described below) extend upward into the articulated portion 516 from the bottom surface 512 of the articulated portion. The sole elements 518 extend downward from the spanning portion 514 as described above. The sole elements 518 may be similar to the non-hexagonal sole elements 208 described above with reference to FIG. 2. The articulated portion 516 also includes multiple lugs 520 and 521 that are connected to and extend downward from the sole elements 518. The lugs may be hexagonal lugs 520 or non-hexagonal lugs 521 and may be similar to the lugs 210*a-b* described above with reference to FIG. 2. Only some of the sipes, sole elements, and lugs can be seen in FIGS. 5A-B.

Figure 5C:
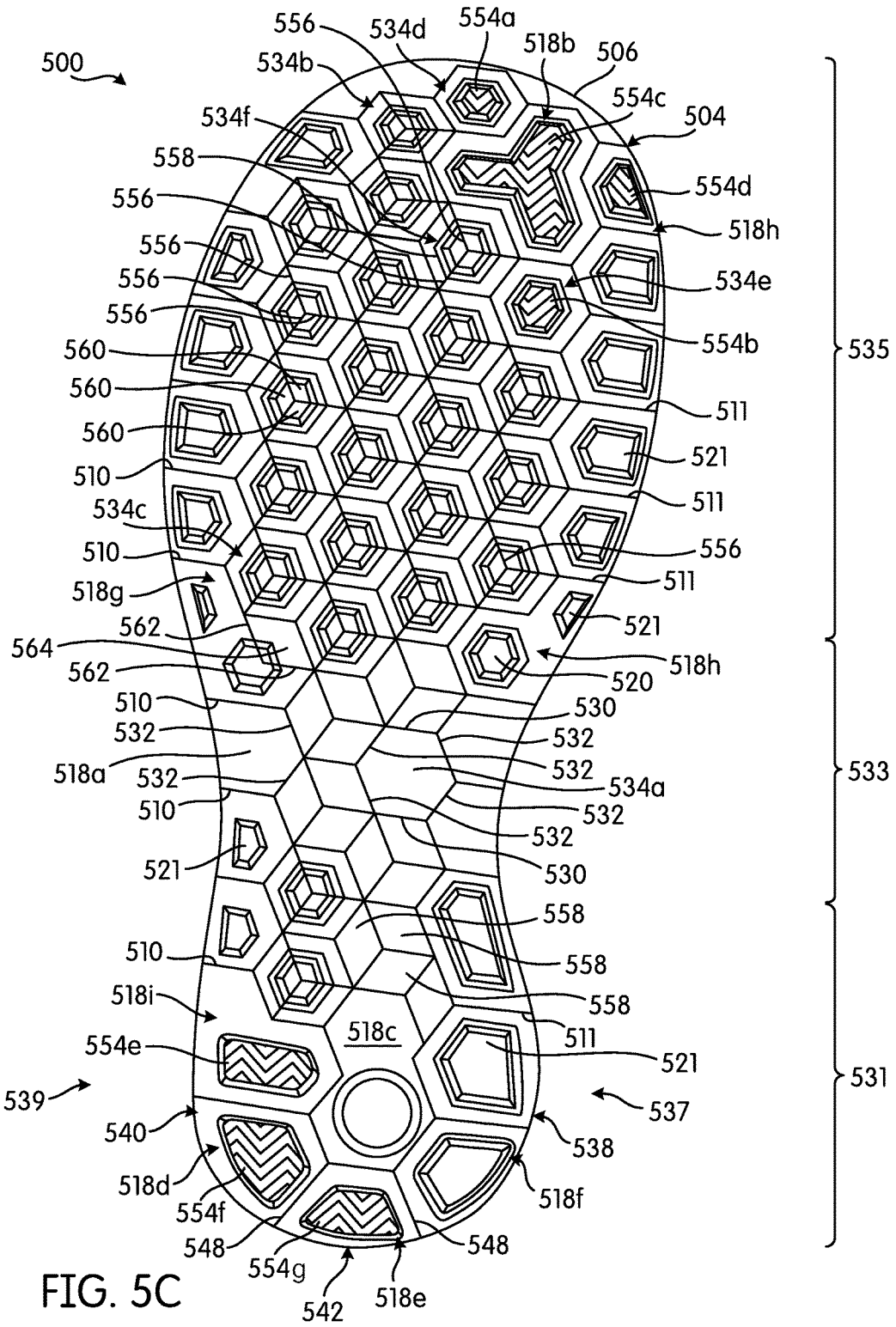
FIG. 5C is a bottom view of the shoe of FIG. 5A and FIG. 5B.

All of the sipes, sole elements, and lugs can be seen in FIG. 5C, a bottom view of the shoe 500 showing the exposed bottom surface of the midsole 506 of the example articulated sole structure 504. Like FIGS. 5A-B, only some of the elements described below are labeled in FIG. 5C. At least a portion of the bottom surface of the midsole 506 of the sole structure 504, in this example, may be similar to the portion of the articulated sole structure 202 described above with reference to FIG. 2. In particular, the midsole 506 includes multiple transverse sipes 530 and oblique sipes 532 that form a hexagonal pattern on the bottom surface of the midsole. The sipes 530 and 532 may also define multiple discrete sole elements 534 and 518. The sole elements may be hexagonal sole elements 534 or non-hexagonal sole elements 518 as described above. The hexagonal sole elements 534 may be located in a region the extends forward through at least a portion of the heel region 531, through the midfoot region 533, and through the forefoot region 535 to a front end of the forefoot region of the articulated sole structure 504. The non-hexagonal sole elements 518 are located along the medial side 537, lateral side 539, and around the rearmost end 542 of the heel region 531 of the articulated sole structure 504. A non-hexagonal sole element 518*b* is also located in the frontmost medial forefoot region 535 of the articulated sole structure 504, and a non-hexagonal sole element 518*c* is also located near the center of the heel region 531 of the articulated sole structure.

The sole structure 504 may also include medial sipes 511 and lateral sipes 510 extending in a transverse direction from the medial edge 538 and the lateral edge 540 of the sole structure respectively. Some of the medial sipes 511 and lateral sipes 510 may extend to a vertex of a hexagonal sole element 534 or to a vertex of a non-hexagonal sole element 518. The articulated sole structure 504 also includes a pair of oblique sipes 548 that extend in an oblique direction from the rear edge into the heel region 531 of the articulated sole structure 504 to define non-hexagonal sole elements 518*d-f* around the rearmost end 542 of the heel region 531 of the sole structure.

The articulated sole structure 504 also includes multiple discrete lugs 520 and 521 that are distributed across the bottom surface of the midsole 506 of the sole structure. The lugs may be hexagonally-shaped lugs 520 or lugs 521 having an alternative polygonal shape, e.g., a non-hexagonal shape. As previously described, some of the sole elements 534 or 518 may include at least one lug 520 or 521 such that the edges of the sole element surround the lug. As seen in the articulated sole structure 504 of FIG. 5C, some of the sole elements may include multiple lugs. For example, non-hexagonal lugs 518*g* and 518*h* each include a hexagonal lug 520 and a non-hexagonal lug 521. The articulated sole structure 504 in FIG. 5C includes lugs 520 and 521 located in a region extending forward from a rear end of the forefoot region 535 to a front end of the forefoot region and across the forefoot region between the lateral edge 540 and medial edge 538 of the articulated sole structure. The articulated sole structure 504 in FIG. 5C also includes lugs 520 and 521 located near a front end of the heel region 531 and near the lateral edge 540 of the articulated sole structure. The articulated sole structure 504 of FIG. 5C further includes lugs 520 and 521 located along the medial edge 538 in the heel region 531 of the articulated sole structure.

One or more discrete sole elements 534 or 518 may further include one or more outsole elements 554 embedded in or otherwise secured to its lower surface as described above. In the articulated sole structure 504 of FIG. 5C, the sole structure includes outsole elements 554 respectively located on three of the laterally-positioned sole elements 518*d-e* and 518*i* in the heel region 531 and on four of the medially-positioned sole elements 534*d-e*, 518*b*, and 518*h* in the frontmost forefoot region 535 of the sole structure. Some of the outsole elements 554*a-b* have a hexagonal shape resembling a hexagonal lug 520, and some of the outsole elements 554*c-g* have an alternative polygonal shape, e.g., a non-hexagonal shape.

Some of the hexagonal sole elements 534 in the articulated sole structure 504 of FIG. 5C also include respective radial sipes 556 that subdivide the hexagonal sole elements. The radial sipes 556 of a hexagonal sole element 534 may be similar to the radial sipes 214 described above with reference to FIG. 2 and may extend from respective vertices toward the center of the hexagonal sole element where they merge together. As also described above, a hexagonal sole element 534 may include three radial sipes 556 that subdivide the hexagonal sole element into three diamond-shaped sole element portions 558. For hexagonal sole elements 534 also having a hexagonal lug 520, the radial sipes 556 may also subdivide the hexagonal lug into three diamond-shaped lug portions 560.

In the articulated sole structure 504 of FIG. 5C, some of the hexagonal sole elements 534 in the heel region 531, midfoot region 533, and forefoot region 535 of the sole structure respectively include three radial sipes 556 that subdivide the hexagonal sole elements into three diamond-shaped sole element portions 558. Instead of three radial sipes, some of the hexagonal sole elements of the articulated sole structure 504 include only two radial sipes and one diamond-shaped sole element portion. For example, the articulated sole structure 504 of FIG. 5C includes a hexagonal sole element 534*f* having only two radial sipes 556 and thus only one diamond-shaped sole element portion 558. In addition, some of the hexagonal sole elements 534 may not include any radial sipes. One or more non-hexagonal sole elements of the sole structure 504 may likewise include sipes that subdivide the non-hexagonal sole elements into one or more diamond-shaped sole element portions. For example, the articulated sole structure in FIG. 5C includes a non-hexagonal sole element 518*g* having two sipes 562 forming one diamond-shaped sole element portion 564 in the non-hexagonal sole element. The diamond-shaped sole element portion 564 of the non-hexagonal sole element 518*g* may be similar to the diamond-shaped sole element portions of some of the hexagonal sole elements 534.

Some of the radial sipes 556 may also be collinear with a lateral sipe 510, medial sipe 511, transverse sipe 530, or oblique sipe 532 of the articulated sole structure 504. In the sole structure 504 of FIG. 5C, for example, medial sipes 511 along the medial edge 538 of the sole structure are collinear with various radial sipes 556 of various hexagonal sole elements 534 near the medial edge of the sole structure. Accordingly, a radial sipe 556 that is collinear with a medial sipe 511 may merge with the medial sipe at a vertex of a hexagonal sole element 534 as shown by way of example in FIG. 5C. A radial sipe 556 of a hexagonal sole element 534 may also be collinear with and merge with a transverse sipe 530 or an oblique sipe 532 that defines an edge of an adjacent sole element 534 or 518.

It will be appreciated that the radial sipes 556 may impart more flexibility to a sole structure 504 by allowing the diamond-shaped sole element portions 558 to move away from each other when the sole structure is flexed about an axis as a wearer walks, runs, or performs other types of movements. Due to the radial sipes 556, the articulated sole structure 504 of FIG. 5C may be more flexible relative to the articulated sole structure 404 of FIG. 4C, which does not include radial sipes. It will also be appreciated that other embodiments of an articulated sole structure may incorporate one or more of the features described above.

Figure 6A:
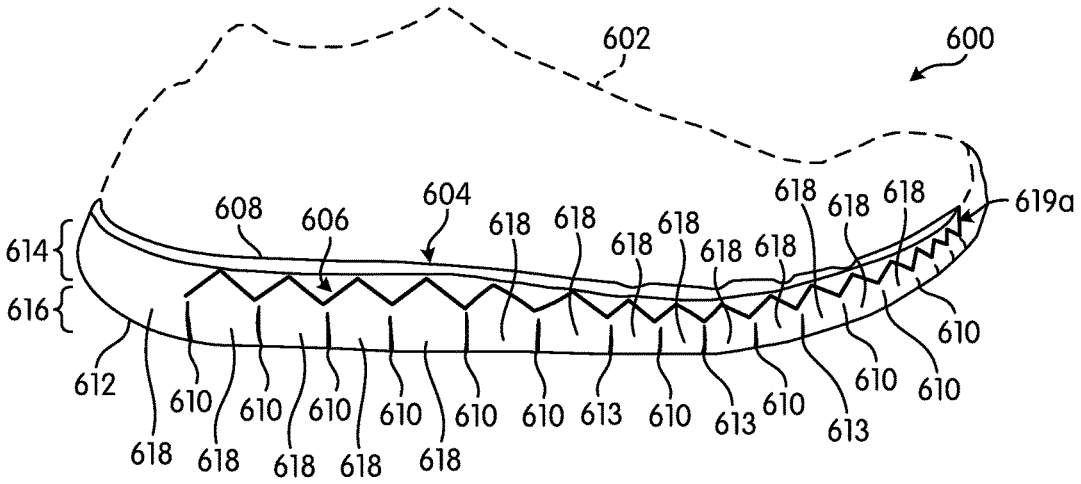
FIG. 6A and FIG. 6B are lateral side and medial side views, respectively, of a shoe according to some embodiments.
Figure 6B:
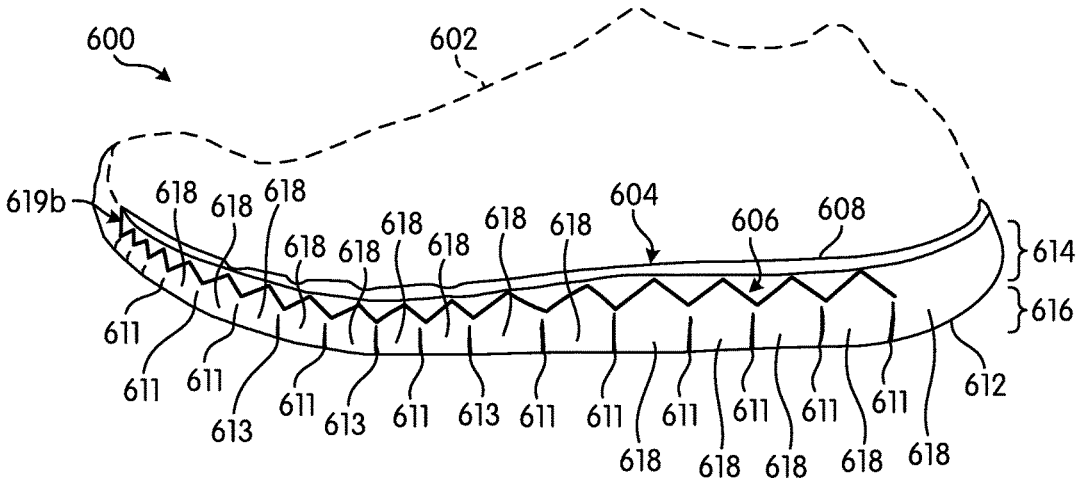

Referring now to FIGS. 6A-B, a lateral side view and a medial side view of a shoe 600 according to at least some additional embodiments are shown in FIG. 6A and FIG. 6B respectively. For clarity, only some of the elements described below are labeled in FIGS. 6A-B. Like the shoes 400 and 500 described above in reference to FIGS. 4A-B and FIGS. 5A-B, the shoe 600 includes an upper 602. As previously indicated, shoes according to various embodiments can include sole structures such as those described herein in combination with any of various types of uppers. Accordingly, the upper 602 is also shown generically in FIGS. 6A-B using a broken line. The upper 602 may include a lasting element and have a construction similar to that described in connection with the upper 402 shown in FIGS. 4A-B. Shoe 600 includes a sole structure 604, which sole structure primarily comprises a single-piece midsole 606. A top surface 608 of midsole 606 may be bonded to the underside of the upper lasting element and to border portions of upper 602. The midsole 606 protects the foot of a shoe wearer from ground surface material. The midsole 606 also provides cushioning by attenuating ground reaction forces and absorbing energy when a wearer of the shoe 600 walks, runs, or performs other types of activities. Suitable materials for the midsole 606 can include any of various materials described above in connection with the midsole 406 of FIGS. 4A-C.

The midsole 606 also includes an articulated construction that imparts relatively high flexibility and articulation and that includes a plurality of sipes 610, 611, and 613 accommodating foot motion. As previously described, at least a portion of the bottom surface 612 of the midsole 606 may be exposed while other portions of the bottom surface of the midsole may be covered by a portion of an outsole or an outsole element. As seen in FIGS. 6A-B, the midsole 606 includes a spanning portion 614 and an articulated portion 616. The precise boundaries of the spanning portion 614 and the articulated portion 616 are only approximately indicated in FIGS. 6A-B. The spanning portion 614 includes the under-footbed portion of midsole 606 above the sipes formed in the bottom surface 612 of the midsole 606 such as sipes 610-611 and 613. The articulated portion 616 includes multiple discrete sole elements 618 that are defined by the sipes 610-611 and 613 (and by other sipes described below). The sipes 610-611 and 613 (and the other sipes described below) extend upward into the articulated portion 616 from the bottom surface 612 of the articulated portion. The sole elements 618 extend downward from the spanning portion 614 as described above. The sole elements 618 may be similar to the hexagonal sole elements 306 or the non-hexagonal sole elements 308 described above with reference to FIG. 3. The articulated portion 616 also includes multiple lugs (FIG. 6C) that are connected to and extend downward from the sole elements 618. Only some of the sipes and sole elements can be seen in FIGS. 6A-B.

Figure 6C:
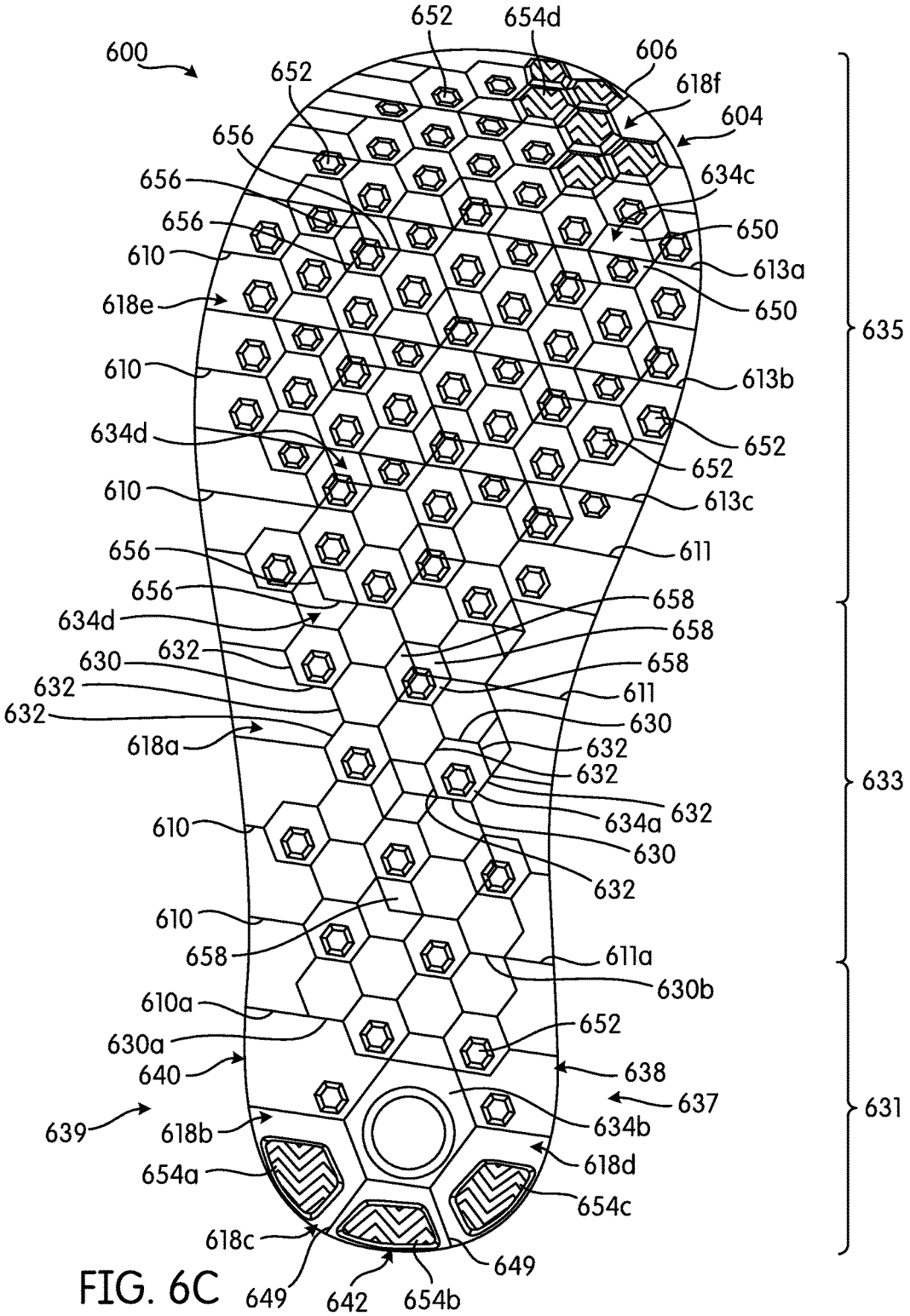
FIG. 6C is a bottom view of the shoe of FIG. 6A and FIG. 6B.

All of the sipes, sole elements, and lugs can be seen in FIG. 6C, a bottom view of the shoe 600 showing the exposed bottom surface of the midsole 606 of the articulated sole structure 604. Like FIGS. 6A-B, only some of the elements described below are labeled in FIG. 6C. At least a portion of the bottom surface of the midsole 606, in this example, may be similar to the portion of the articulated sole structure 302 described above with reference to FIG. 3. In particular, the sole structure 604 includes multiple transverse sipes 630 and oblique sipes 632 that form a hexagonal pattern on the bottom surface of the midsole 606. The sipes 630 and 632 may also define multiple discrete sole elements 634 and 618. The sole elements may be hexagonal sole elements 634 or non-hexagonal sole elements 618 as described above. The hexagonal sole elements 634 may be located in a region that extends forward through at least a portion of the heel region 631, through the midfoot region 633, and through the forefoot region 635 to a front end of the forefoot region of the articulated sole structure 604. The non-hexagonal sole elements 618 are located along the medial side 637, lateral side 639, and around the rearmost end 642 of the heel region 631 of the articulated sole structure 604. A hexagonal sole element 634*b* is also located near the center of the heel region 631 of the articulated sole structure 604.

The articulated sole structure 604 of FIG. 6C also includes medial sipes 611 and lateral sipes 610 extending in a transverse direction from the medial edge 638 and the lateral edge 640 of the sole structure respectively. Some of the medial sipes 611 and lateral sipes 610 may extend to a vertex of a hexagonal sole element 634 or to a vertex of a non-hexagonal sole element 618. The articulated sole structure 604 also includes a pair of oblique sipes 649 that extend in an oblique direction from the rear edge and into the heel region 631 of the articulated sole structure to define non-hexagonal sole elements 618*b-d* around the rearmost end 642 of the heel region 631 of the sole structure. Some of the lateral sipes 610 and some of the medial sipes 611 may be collinear with a transverse sipe 630 that defines an edge of respective hexagonal sole elements 634. For example, lateral sipe 610*a* is collinear with transverse sipe 630*a* and merges with the transverse sipe such that the lateral sipe is contiguous with the transverse sipe. Likewise medial sipe 611*a* is collinear with transverse sipe 630*b* and merges with the transverse sipe such that the medial sipe is also contiguous with the transverse sipe.

The articulated sole structure 604 of FIG. 6C further includes sipes 613*a-c* extending in a transverse direction from the medial edge 638 of the sole structure to the lateral edge 640 of the sole structure. The sipes 613*a-c* extending from the medial edge 638 to the lateral edge 640 of the sole structure 604 may thus be referred to as mediolateral sipes. In this example, three mediolateral sipes 613*a-c* are respectively located near a rear end, middle, and front end of the forefoot region 635 of the sole structure 604. It will thus be appreciated that the mediolateral sipes 613*a-c* may impart flexibility to the forefoot region 635 of the articulated sole structure 604 when the forefoot region is flexed about a transverse axis. As seen in FIG. 6C, the mediolateral sipes 613*a-c* may pass through the center of some of the hexagonal sole elements 634 thus bisecting the hexagonal sole elements. For example, a mediolateral sipe 613*a* bisects hexagonal sole element 634*c* into two trapezoidal-shaped sole element portions 650. As also seen in FIG. 6C, the mediolateral sipes 613*a-c* may define an edge of one or more of the hexagonal sole elements 634 and/or non-hexagonal sole elements 618. For example, the mediolateral sipe 613*c* defines an edge of hexagonal sole element 634*d*, and the mediolateral sipe 613*b* defines an edge of the non-hexagonal sole element 618*e*. Stated differently, some of the hexagonal sole elements 634 and some of the non-hexagonal sole elements 618 may be defined by a combination of the transverse sipes 630, the oblique sipes 632, and mediolateral sipes 613, which may correspond to the respective edges of a hexagonal sole element or non-hexagonal sole element.

The articulated sole structure 604 in FIG. 6C also includes multiple discrete lugs 652 that are distributed across the bottom surface of the midsole 606. The lugs 652, in this example, are hexagonally-shaped lugs (hexagonal lugs). The sole elements 634 and 618, in this example, may include a hexagonal lug 652 such that the edges of the sole element surround the lug. Various sole elements 634 and 618 in the heel region 631, midfoot region 633, and forefoot region 635 of the articulated sole structure 604 include a hexagonal lug 652. Additionally, some of the sole elements 634 and 618 may not include a lug as seen in the example sole structure 604 of FIG. 6C.

One or more discrete sole elements 634 or 618 may further include an outsole element 654 embedded in or otherwise secured to its lower surface as described above. In the articulated sole structure 604 of FIG. 6C, the sole structure includes outsole elements 654*a-c* respectively located on three of the sole elements 618*b-d* near a rear end of the heel region 631. The articulated sole structure 604 also includes an outsole element 654*d* located in the frontmost forefoot region 635 of the sole structure near the medial edge 638. The outsole element 654*d* may have multiple hexagonal-shaped subsections.

Some of the hexagonal sole elements 634 in the articulated sole structure 604 of FIG. 6C may also include respective radial sipes 656 that subdivide the sole elements. As described above with reference to FIG. 3, radial sipes 656 of a hexagonal sole element 634 may extend from respective vertices toward the center of the hexagonal sole element where they merge together. As also described above, a hexagonal sole element 634 may include two or three radial sipes 656 that respectively subdivide the hexagonal sole element into one or three diamond-shaped sole element portions 658. For example, hexagonal sole element 634*d* includes three radial sipes 656 subdividing the hexagonal sole element into three diamond-shaped sole element portions 658. Additionally, hexagonal sole element 634*d* includes two radial sipes 656 defining only one diamond-shaped sole element portion 658 for the hexagonal sole element. In the articulated sole structure 604 of FIG. 6C, some of the hexagonal sole elements 634 include respective radial sipes 656 while other hexagonal sole elements do not have radial sipes. Some of the radial sipes 656 may also be collinear and merge with a lateral sipe 610, medial sipe 611, transverse sipe 630, or oblique sipe 632 of the articulated sole structure 604.

The articulated sole structures 404, 504, and 604 respectively described with reference to FIGS. 4C, 5C, and 6C may be more or less flexible relative to one another. An articulated sole structure may include various features described above, and the degree of flexibility of the sole structure may depend on which features the sole structure incorporates. The articulated sole structure 404 of FIG. 4C, for example, may be flexible about one or more axes due to the transverse sipes and oblique sipes defining the hexagonal sole elements of the sole structure. The articulated sole structure 504 of FIG. 5C may be more flexible relative to the articulated sole structure 404 of FIG. 4C due to the radial sipes additionally formed in the sole structure that subdivide the hexagonal sole elements into diamond-shaped sole element portions. Furthermore, the articulated sole structure 604 of FIG. 6C may be more flexible relative to the articulated sole structure 504 of FIG. 5C due to the greater number of sipes, the greater number of sole elements defined by those sipes, and the relatively smaller dimensions of the sipes and sole elements.

Figure 7A:
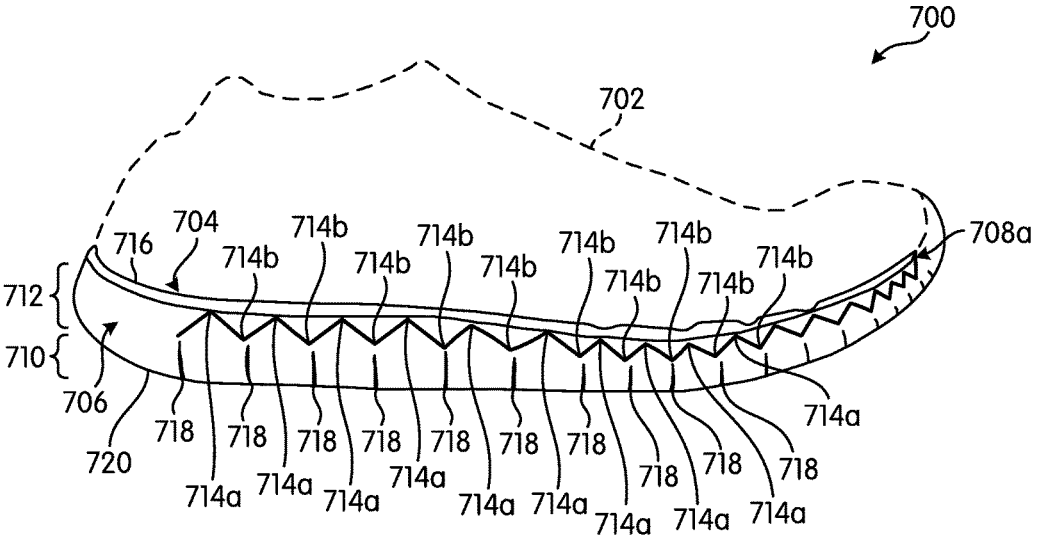
FIG. 7A and FIG. 7B are lateral side and medial side views, respectively, of a shoe according to some embodiments.
Figure 7B:
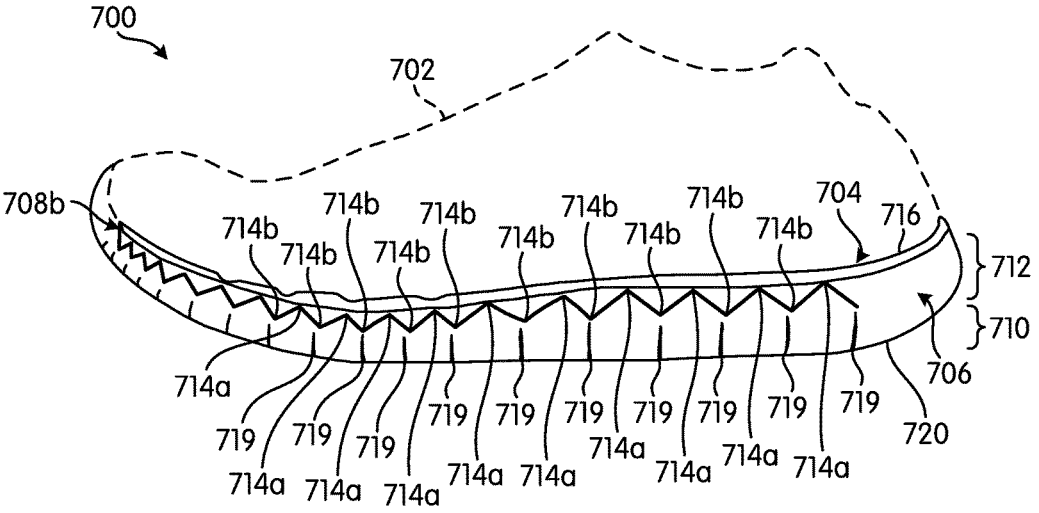

Referring now to FIGS. 7A-B, a lateral side view and a medial side view of a shoe 700 are shown. For clarity, only some of the elements described below are labeled in FIGS. 7A-B. The shoe 700 may be similar to and include elements and features similar to the shoe 600 discussed above with reference to FIG. 6. The shoe 700 may have an upper 702 and an articulated sole structure 704 attached to the upper similar to the shoe 400 described above with reference to FIGS. 4A-B. The articulated sole structure 704 may comprise a single-piece midsole 706 as also described above. The midsole 706 includes an articulated portion 710 and a spanning portion 712. The precise boundaries of articulated portion 710 and the spanning portion 712 are only approximately indicated in FIGS. 7A-B. The spanning portion 710 includes the portion of the midsole 706 above the sipes formed in and extending upward into the articulated portion 710 such as sipes 418.

The midsole 706 may include at least one sipe 708 having a curved shape that extends sideward into the midsole. A sipe 708 having a curved shape may thus be referred to as a curved sipe. The particular shape of a curved sipe may vary in various embodiments of the midsole 706. In some embodiments, a curved sipe may have a jagged shape that resembles a triangle wave as shown by way of example in FIGS. 7A-B. In other example embodiments, an curved sipe may have a wavy shape that resembles a sinusoidal wave. Moreover, some example embodiments of the midsole may include a curved sipe having a combination of shapes, e.g., a curved sipe where a portion of the sipe has a jagged shape and another portion of the sipe has a wavy shape. The shape of the curved sipe may thus result in opposing contoured surfaces in the midsole that abut against each other to resist twisting. A curved sipe may have a depth between about 1 mm to about 5 mm, and in some example embodiments the depth of an undulating sipe may be about 2-3 mm.

As seen in FIG. 7A, the midsole 706, in this example, includes a curved sipe 708*a* formed in the lateral side of the midsole and extending sideward into the midsole. As seen in FIG. 7B, the midsole 706, in this example, includes another curved sipe 708*b* formed in the medial side of the midsole and extending sideward into the midsole. In the example midsole 706 of FIGS. 7A-B, the curved sipes 708*a-b* are located in the midsole above the sipes 718-719 respectively formed in the bottom surface of the midsole and extending upward into the midsole. In example embodiments, at least a portion of a curved sipe 708*a* or 708*b* may extend into the articulated portion 710 of the midsole and/or the spanning portion of the midsole. In some example embodiments, a curved sipe may be formed on both the medial side and the lateral side of the sole structure of a shoe. In other example embodiments, a shoe may include only one curved sipe on either the medial side or the lateral side of the sole structure of the shoe.

As shown by way of example in FIGS. 7A-B, the curved sipes 708*a-b* may have a jagged shape and be located in a region that extends along the articulated portion 710 of the midsole 706 from at least a portion of the heel region, through the midfoot region, and to a front end of the forefoot region of the sole structure 704. The shape of the curved sipes 708*a-b* may define respective vertices 714*a-b*. Some of the vertices 714*a* may be positioned near a top edge 716 of the articulated portion 710 and correspond to a peak of a curved sipe 708. Other vertices 714*b* may be positioned away from the top edge 716 of the articulated portion 710 and correspond to a valley of a curved sipe 708. A vertex 714*a* corresponding to a peak of a curved sipe 708 may thus be referred to as a peak vertex, and a vertex 714*b* corresponding to a valley of a curved sipe may thus be referred to as a valley vertex. In the example sole structure of FIGS. 7A-B, some of the valley vertices 714*b* are respectively located roughly adjacent to a sipe 718 or 719 formed in the bottom surface 720 of the midsole 706.

The curved sipes 708*a-b* may provide a functional advantage with respect to the fit of the shoe 700 on the foot of the wearer. In particular, the curved sipes 708*a-b* may allow the spanning portion 712 to separate from the articulated portion 710 in response to tension on the upper 702, e.g., as the shoe 700 is pulled over the foot of the wearer and laced up. By allowing the spanning portion 712 to separate from the articulated portion 710, at least portion of the midsole 706 may advantageously wrap around at least a portion of the foot of the wearer thereby providing a relatively more snug fit. Moreover, the curved shape of the sipe imparts stability to the midsole as the wearer walks, runs, or performs other types of motions. It will be appreciated that the curved shape of the sipe results in opposing contoured surfaces in the midsole 706. As the foot of the wearer twists from side-to-side during movement of the foot, the contours of the surfaces may abut against each other thereby resisting the twisting motion and providing stability. Accordingly, the shape of a curved sipe such as curved sipes 708*a-b* may impart both flexibility and stability-flexibility as the wearer pulls on the shoe and stability as the wearer walks, runs, or performs other types of movements.

Other embodiments of articulated sole structures may include a curved sipe. In FIG. 6, for example, the example articulated sole structure 606 includes curved sipes 619*a-b* similar to the curved sipes 708*a-b* described above. The example sole structure 406 of the shoe 400 in FIGS. 4A-B and the example sole structure 506 of the shoe 500 in FIGS. 5A-B may also include curved sipes similar to the curved sipes 708*a-b*.

Figure 8A:
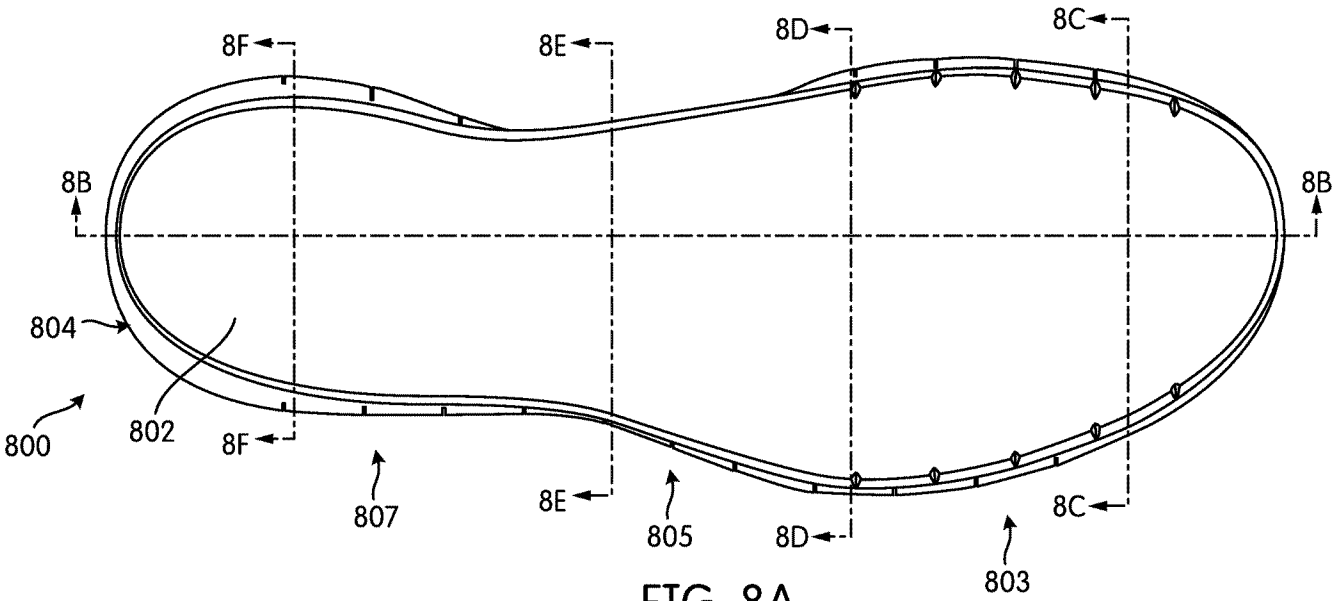
FIG. 8A is a top-down view of a sole structure according to some embodiments.
Figure 8B:
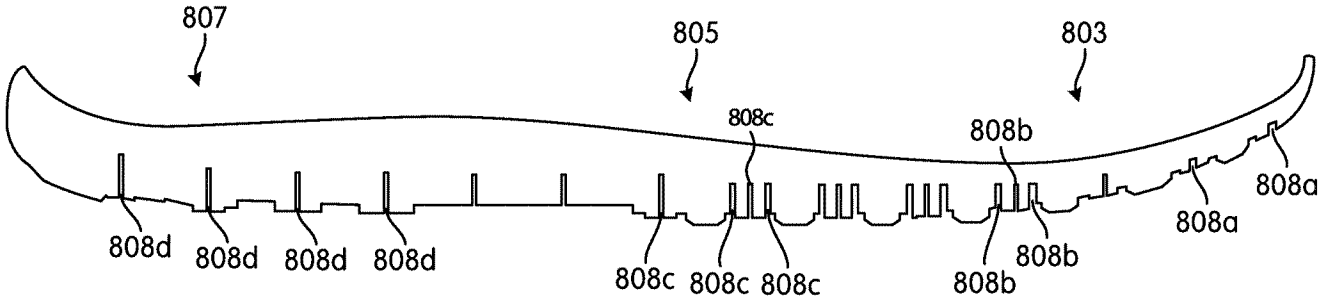
FIGS. 8B-F are respective area cross-sectional views of the sole structure of FIG. 8A.
Figure 8C:
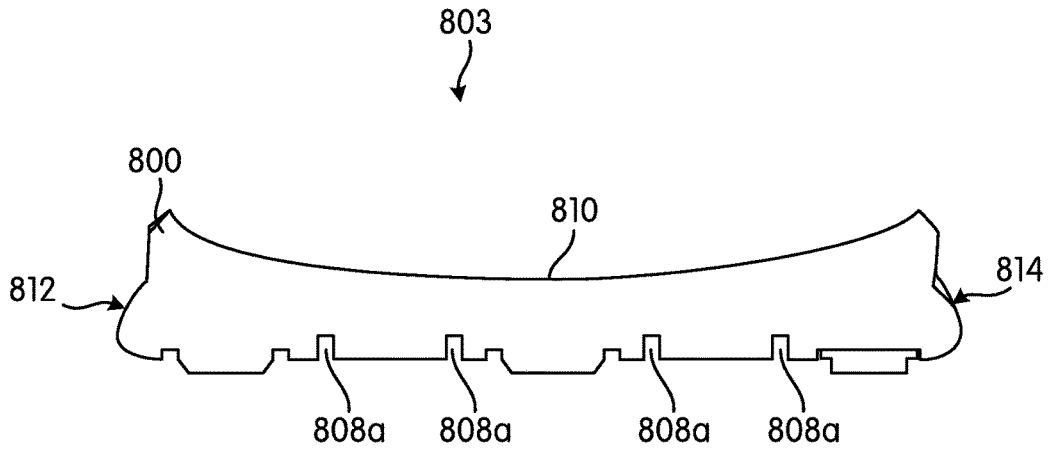
Figure 8D:
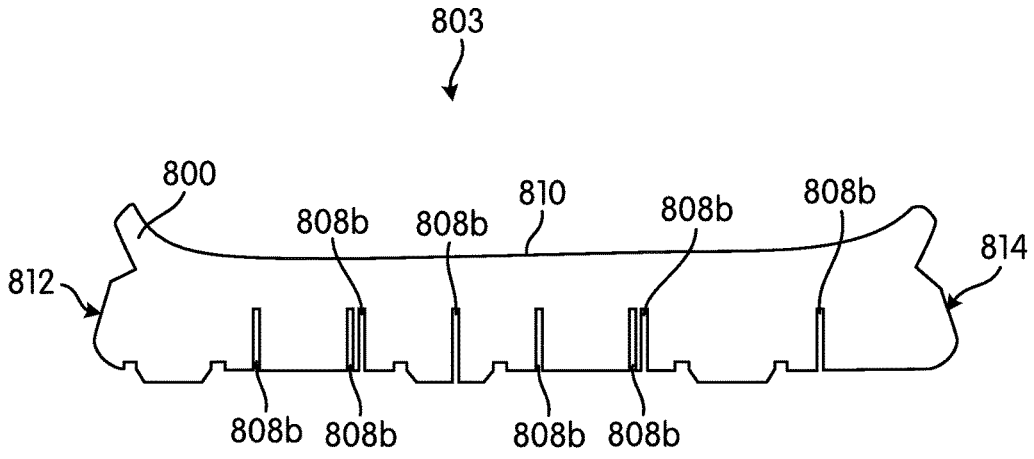
Figure 8E:
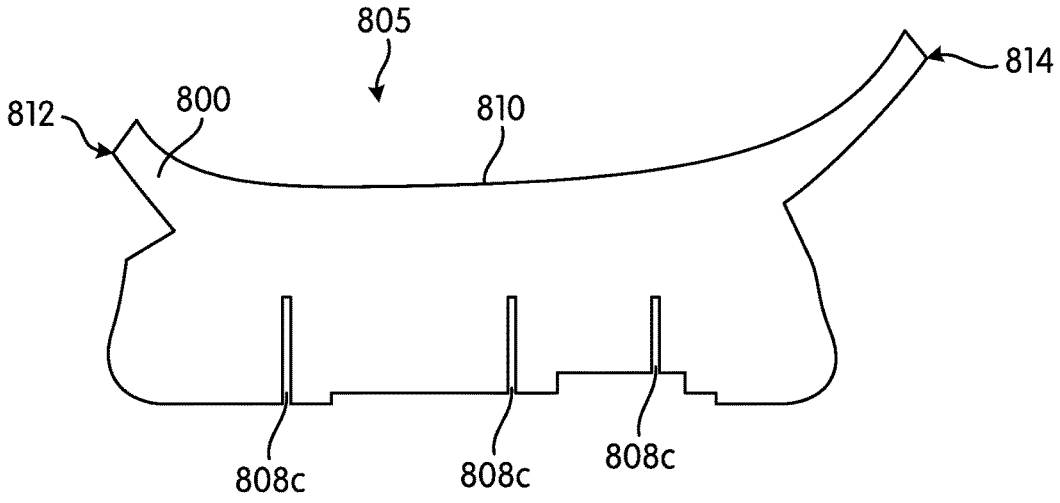
Figure 8F:
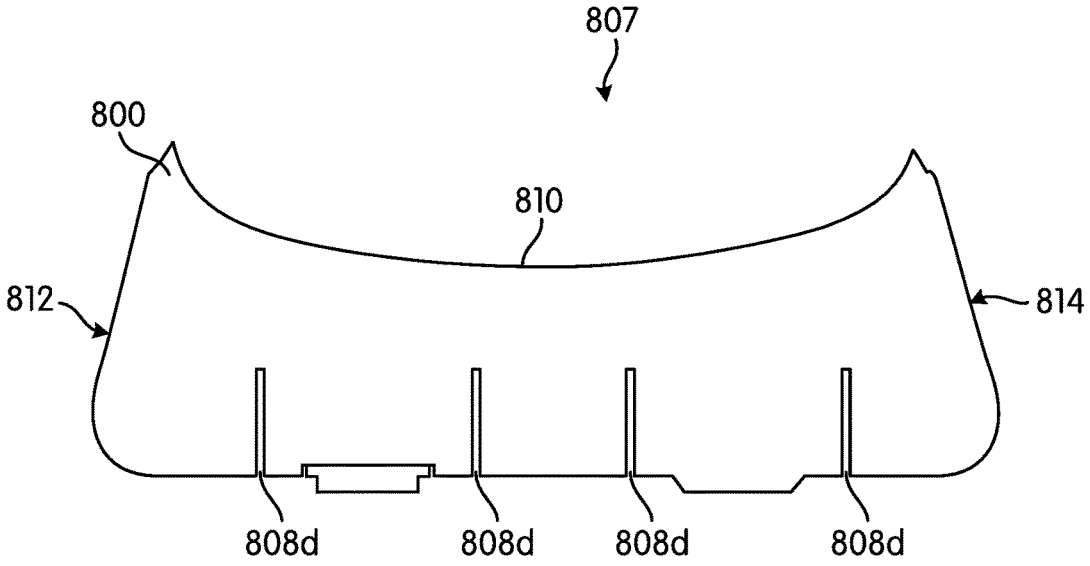

Referring now to FIGS. 8A-F, a top view of the articulated sole structure 800 is shown. The articulated sole structure 800 may be similar to and include elements and features similar to the articulated sole structure 504 described above with reference to FIGS. 5A-C. In FIG. 8A, the top surface 802 of the midsole 804 of the sole structure 504 is seen. The top surface 508 of midsole 506 may be bonded to the underside of the upper lasting element and to border of a shoe upper as described above. In FIG. 8A, a top down view of the sole structure 800 is shown. FIGS. 8B-F are respective area cross-sectional views of the sole structure 800. The area cross-sectional views are taken along various lines shown in FIG. 8A. Line 8B extends in a longitudinal direction across the middle of the sole structure 800. FIG. 8B is an area cross-sectional view of the sole structure 800 along line 8B. Line 8C extends in a transverse direction across a forward end of the forefoot region 803 of the sole structure 800. FIG. 8C is an area cross-sectional view of the sole structure 800 along line 8C. Line 8D extends in a transverse direction across a rear end of the forefoot region 803 of the sole structure 800. FIG. 8D is an area cross-sectional view of the sole structure 800 along line 8D. Line 8E extends in a transverse direction across the midfoot region 805 of the sole structure. FIG. 8E is an area cross-sectional view of the sole structure 800 along line 8E. Line 8F extends in a transverse direction across the heel region 807 of the sole structure. FIG. 8F is an area cross-sectional view of the sole structure 800 along line 8F. For clarity, not all of the elements are labeled in FIGS. 8A-F.

The depth of the sipes 808*a-d* can be seen in FIGS. 8B-F. As also seen in FIGS. 8B-F, the depth of the sipes 808*a-d* may vary in the forefoot region 803, midfoot region 805, and heel region 807. In this sole structure 800, the sipes 808*b* near the rear end of the forefoot region 803 are deeper than the sipes near the forward end of the forefoot region. The sipes 808*c* in the midfoot region 805 and the sipes 808*d* in the heel region 807 are also deeper than the sipes 808*a* near the forward end of the forefoot region 803 in this sole structure 800. Various sipes 808*a* near the forward end of the forefoot region 803 may have a depth of about 2 mm to about 3 mm; various sipes 808*b* near the rear end of the forefoot region may have a depth of about 7 mm to about 8 mm; various sipes 808*c* in the midfoot region 805 may have a depth of about 7 mm to about 10 mm; and various sipes 808*d* in the heel region 807 may have a depth of about 10 mm. Additionally, various sipes 808*a-d* may have a width of about 1 mm to about 2 mm.

As seen in FIGS. 8B-F, the thickness of the sole structure 800 may also vary across the forefoot region 803, midfoot region 805, and heel region 807. With reference to FIGS. 8B-F, the thickness of the sole structure 800 varies in a transverse direction across the sole structure. Near the forward end of the forefoot region 803, the thickness of the sole structure 800 near the center of the footbed 810 may be about 9 mm to about 11 mm, and in some embodiments may be about 10 mm. Near the forward end of the forefoot region 803, the thickness of the sole structure near the medial edge 812 and lateral edge 814 may be about 15 mm to about 17 mm, and in some example embodiments may be about 16 mm. Near the rear end of the forefoot region 803, the thickness of the sole structure 800 near the center of the footbed 810 may be about 13 mm to about 15 mm, and in some embodiments may be about 14 mm. Near the rear end of the forefoot region 803, the thickness of the sole structure near the medial edge 812 and lateral edge 814 may be about 19 mm to about 21 mm, and in some example embodiments may be about 20 mm. In the midfoot region 805 and in the heel region 807, the thickness of the sole structure 800 near the center of the footbed 810 may be about 19 mm to about 21 mm, and in some embodiments may be about 20 mm. In the midfoot region 805, the thickness of the sole structure 800 near the medial edge 812 may be about 25 mm to about 27 mm, and in some example embodiments may be about 26 mm; and the thickness of the sole structure near the lateral edge 814 may be about 33 mm to about 35 mm, and in some example embodiments may be about 34 mm. In the heel region 807, the thickness of the sole structure near the medial edge 812 and the lateral edge 814 may be about 29 mm to about 31 mm, and in some example embodiments may be about 30 mm.

In view of these sipe depths and sole thicknesses, it will be recognized that the ratio of sipe depth to sole thickness may also vary across the forefoot region 802, midfoot region 804, and heel region 806 of the sole structure. In the sole structure 800, the ratio of sipe depth to sole thickness near the forward end of the forefoot region 802 may be about 0.2 to about 0.3; the ratio of sipe depth to sole thickness near the rear end of the forefoot region 802 may be about 0.5; the ratio of sipe depth to sole thickness in the midfoot region 804 may be about 0.5 to about 0.7; and the ratio of sipe depth to sole thickness in the heel region 806 may be about 0.7. Other embodiments of the sole structure may exhibit alternative sipe depths, sole thicknesses, and ratios of sipe depth to sole thickness.

It will be appreciated that one or more features described above with reference to the midsole of an articulated sole structure may also be implemented in an outsole of an articulated sole structure. For example, an outsole of an articulated sole structure may include transverse sipes and oblique sipes formed in the bottom surface of the outsole that define multiple discrete sole elements that include hexagonal sole elements and non-hexagonal sole elements. Other examples of outsoles that incorporate various features described above will be appreciated with the benefit of this disclosure. Moreover, the dimensions described above are provided as examples. Embodiments of the articulated sole structure that incorporate some or all of the features described above may include dimensions outside of the ranges identified above.

Various additional embodiments include articulated sole structures that may have appearances differing from those shown in FIGS. 1-8F. As but one example, the sizes of sole elements, lugs and/or other features may vary across a sole structure in ways in addition to (or other than) those shown in FIGS. 1-8F. As a further example, relative locations of certain features (e.g., the location of a lug on a sole element) may vary from those described above and/or on a particular embodiment. As an additional example, the total number and size of the sipes, the total number and size of the sole elements, and the total number and size of the lugs may be varied across particular embodiments of the articulated sole structure.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, sub-combinations and permutations of features from above-described embodiments are the within the scope of the invention. With regard to claims directed to an apparatus, an article of manufacture or some other physical component or combination of components, a reference in the claim to a potential or intended wearer or a user of a component does not require actual wearing or using of the component or the presence of the wearer or user as part of the claimed component or component combination.

What is claimed is:

1. An articulated sole structure comprising:

a footwear sole structure spanning portion extending longitudinally along a length of the sole structure and transversely between medial and lateral sides of the articulated sole structure; and an articulated portion located below the footwear sole structure spanning portion and comprising:

a plurality of sipes extending upward into the articulated portion from a bottom surface of the articulated portion and forming a hexagonal pattern on the bottom surface of the articulated portion, a plurality of discrete hexagonally-shaped sole elements extending downward from the footwear sole structure spanning portion, wherein individual hexagonally-shaped sole elements are at least partially defined by one or more sipes of the plurality of sipes, and a plurality of hexagonal lugs, one of the hexagonal lugs being connected to and extending downward from a bottom surface of one of the discrete hexagonally-shaped sole elements;

wherein one or more first sipes of the plurality of sipes located in a forefoot region and one or more second sipes of the plurality of sipes located in a heel region of the articulated sole structure are deeper relative to one or more third sipes of the plurality of sipes located in the forefoot region.

2. The articulated sole structure of claim 1 wherein:

one of the hexagonal lugs is oriented such that an edge of the hexagonal lug is disposed toward the forefoot region and extends in a transverse direction across the sole structure.

3. The articulated sole structure of claim 1 wherein:

one of the hexagonally-shaped sole elements comprises a plurality of radial sipes extending upward into the articulated portion from the bottom surface of the articulated portion; and individual radial sipes of the plurality of radial sipes extend from respective vertices of the hexagonally-shaped sole element toward a center of the hexagonally-shaped sole element such that the plurality of radial sipes subdivide the hexagonally-shaped sole element into at least one uninterrupted diamond-shaped sole element portion, each of the respective vertices being defined by a junction of two respective sipes of the plurality of sipes.

4. The articulated sole structure of claim 3 wherein the plurality of radial sipes includes three radial sipes that subdivide the hexagonally-shaped sole element into three uninterrupted diamond-shaped sole element portions.

5. The articulated sole structure of claim 1 wherein:

individual hexagonal lugs of the plurality of hexagonal lugs have an edge-to-edge diameter of about 11 mm to about 13 mm; and individual hexagonal lugs of the plurality of hexagonal lugs have a height of about 1 mm to about 3 mm.

6. The articulated sole structure of claim 1 wherein one of the hexagonally-shaped sole elements includes sides that are about the same length such that the hexagonally-shaped sole element resembles a regular hexagon.

7. The articulated sole structure of claim 6 wherein one of the hexagonally-shaped sole elements has an edge-to-edge diameter of about 18 mm to about 20 mm.

8. The articulated sole structure of claim 1 wherein:

one or more of the sipes located in the forefoot region near a forward end of the forefoot region have a sipe depth of about 2 mm to about 3 mm;

one or more of the sipes located in the forefoot region near a rear end of the forefoot region have a sipe depth of about 7 mm to about 8 mm;

one or more of the sipes located in a midfoot region of the articulated sole structure have a sipe depth of about 7 mm to about 10 mm; and one or more of the sipes located in the heel region have a sipe depth of about 10 mm.

9. The articulated sole structure of claim 8 further comprising at least one outsole element covering a portion of the articulated portion.

10. The articulated sole structure of claim 1 further comprising:

a plurality of lateral sipes extending upward into the articulated portion from a bottom surface of the articulated portion and extending in a transverse direction from the lateral side toward the medial side of the articulated portion; and a plurality of medial sipes extending upward into the articulated portion from the bottom surface of the articulated portion and extending in a transverse direction from the medial side toward the lateral side of the articulated portion.

11. The articulated sole structure of claim 10 further comprising:

at least one mediolateral sipe extending upward into the articulated portion, the at least one mediolateral sipe being located in the forefoot region and extending across the entire width of the of the articulated portion in a transverse direction from a medial edge of the articulated portion to a lateral edge of the articulated portion; and wherein the at least one mediolateral sipe bisects at least one of the hexagonally-shaped sole elements.

12. The articulated sole structure of claim 11 wherein:

the at least one mediolateral sipe is one of three mediolateral sipes located in the forefoot region; and the three mediolateral sipes are substantially parallel to each other.

13. An articulated sole structure comprising:

a footwear sole structure spanning portion extending longitudinally along a length of the sole structure and transversely between medial and lateral sides of the sole structure; and an articulated portion located below the footwear sole structure spanning portion and comprising:

a plurality of sipes extending upward into the articulated portion from a bottom surface of the articulated portion and forming a hexagonal pattern on the bottom surface of the articulated portion, and a plurality of discrete hexagonally-shaped sole elements extending downward from the footwear sole structure spanning portion, wherein individual hexagonally-shaped sole elements are at least partially defined by one or more sipes of the plurality of sipes;

wherein one of the hexagonally-shaped sole elements comprises a plurality of radial sipes extending upward into the articulated portion from the bottom surface of the articulated portion and a radial sipe of the plurality of radial sipes extends from a vertex of the hexagonally-shaped sole element toward a center of the hexagonally-shaped sole element such that the plurality of radial sipes subdivide the hexagonally-shaped sole element into at least one uninterrupted diamond-shaped sole element portion, the vertex being defined by a junction of two sipes of the plurality of sipes.

14. The articulated sole structure of claim 13 wherein the plurality of radial sipes includes three radial sipes that subdivide the hexagonally-shaped sole element into three uninterrupted diamond-shaped sole element portions.

15. The articulated sole structure of claim 13 wherein the footwear sole structure spanning portion defines, opposite the bottom surface of the articulated portion, an uninterrupted surface longitudinally along the length of the sole structure and transversely between the medial and lateral sides of the sole structure.

* * * * *